US010394149B2

(12) United States Patent
Yoshida et al.

(10) Patent No.: US 10,394,149 B2
(45) Date of Patent: Aug. 27, 2019

(54) BINDER RESIN COMPOSITION FOR ELECTROSTATIC IMAGE DEVELOPING TONERS

(71) Applicant: Kao Corporation, Tokyo (JP)

(72) Inventors: Tomohide Yoshida, Wakayama (JP); Shoichi Murata, Wakayama (JP); Manabu Suzuki, Wakayama (JP); Eiji Shirai, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 15/572,687

(22) PCT Filed: May 18, 2016

(86) PCT No.: PCT/JP2016/064729
§ 371 (c)(1),
(2) Date: Nov. 8, 2017

(87) PCT Pub. No.: WO2016/186129
PCT Pub. Date: Nov. 24, 2016

(65) Prior Publication Data

US 2018/0136575 A1 May 17, 2018

(30) Foreign Application Priority Data

May 19, 2015 (JP) ..... 2015-102090

(51) Int. Cl.
*G03G 9/087* (2006.01)
*G03G 9/08* (2006.01)

(52) U.S. Cl.
CPC ..... *G03G 9/08786* (2013.01); *G03G 9/081* (2013.01); *G03G 9/08704* (2013.01); *G03G 9/08722* (2013.01); *G03G 9/08755* (2013.01); *G03G 9/08782* (2013.01); *G03G 9/08795* (2013.01); *G03G 9/08797* (2013.01)

(58) Field of Classification Search
CPC ..... G03G 9/08755; G03G 9/08704; G03G 9/087; G03G 9/08786; G03G 9/08782; G03G 9/08797
See application file for complete search history.

(56) References Cited

U.S. PATENT DOCUMENTS

| | | | | |
|---|---|---|---|---|
| 5,428,435 | A | 6/1995 | Yasuda et al. | |
| 8,329,371 | B2 | 12/2012 | Mikuriya et al. | |
| 8,501,379 | B2 | 8/2013 | Sugimoto et al. | |
| 8,852,834 | B2 | 10/2014 | Santo et al. | |
| 2008/0153018 | A1 | 6/2008 | Mikuriya et al. | |
| 2009/0186291 | A1 | 6/2009 | Mikuriya et al. | |
| 2010/0009279 | A1* | 1/2010 | Hidaka | G03G 9/08755 430/108.23 |
| 2012/0021350 | A1* | 1/2012 | Fukuri | C08G 63/52 430/109.4 |
| 2014/0010577 | A1* | 1/2014 | Devlieghere | G03G 15/01 399/302 |
| 2015/0037727 | A1* | 2/2015 | Fukudome | G03G 9/08755 430/109.3 |
| 2018/0136575 | A1* | 5/2018 | Yoshida | G03G 9/081 |

FOREIGN PATENT DOCUMENTS

| | | | |
|---|---|---|---|
| EP | 0 961 175 | A2 | 12/1999 |
| JP | 5-197190 | A | 8/1993 |
| JP | 10-87839 | A | 4/1998 |
| JP | 2006-113497 | A | 4/2006 |
| JP | 2008-158276 | A | 7/2008 |
| JP | 2009-3024 | A | 1/2009 |
| JP | 2009-109957 | A | 5/2009 |
| JP | 2012-88345 | A | 5/2012 |
| JP | 2014-89428 | A | 5/2014 |
| JP | 2016-65935 | A | 4/2016 |

OTHER PUBLICATIONS

International Search Report dated Jun. 21, 2016, in PCT/JP2016/064729 filed May 18, 2016.
European Search Report dated Oct. 25, 2018 issued in corresponding application EP16796522.

* cited by examiner

*Primary Examiner* — Christopher D Rodee
(74) *Attorney, Agent, or Firm* — Oblon, McClelland, Maier & Neustadt, L.L.P.

(57) ABSTRACT

The present invention provides a toner for development of electrostatic images including a polyester-based resin and a polypropylene-based wax, which is excellent in fusing properties on a polypropylene film. The present invention relates to [1] a resin binder composition for toners for development of electrostatic images which has an endothermic amount ratio $\Delta H_{CW/W}$ of not less than 0.10 and not more than 0.80, [2] a resin binder composition for toners for development of electrostatic images in which a volume-median particle size ($D_{50}$) of a wax as a whole contained therein is not less than 1 μm and not more than 50 μm; a volume-median particle size ($D_{50}$) of a small particle size component of the wax is not less than 20 nm and not more than 400 nm; and a content of the small particle size component in the wax is not less than 20% by mass and not more than 90% by mass, [3] a process for producing a resin binder composition for toners for development of electrostatic images in which a polypropylene-based wax is added to a reaction system prior to addition polymerization upon production of a composite resin as a resin binder; and [4] a toner for development of electrostatic images including the resin binder composition as described in the above [1] or [2].

8 Claims, No Drawings

BINDER RESIN COMPOSITION FOR ELECTROSTATIC IMAGE DEVELOPING TONERS

FIELD OF THE INVENTION

The present invention relates to a resin binder composition for toners for development of electrostatic images, a process for producing the resin binder composition and a toner for development of electrostatic images including the resin binder composition.

BACKGROUND OF THE INVENTION

In the field of electrophotography, with the progress of electrophotographic systems, it has been demanded to develop toners for development of electrostatic images which are adaptable for high image quality and high copying or printing speed.

On the other hand, owing to the diversification of printing media, there now occurs a demand for electrophotographic printing technologies using media other than paper media. One of the main media is a polypropylene (PP) film which has been used for labels of PET bottles, various packages or the like.

For example, Patent Literature 1 discloses a toner for development of electrostatic images which is constituted of toner particles that contain at least a resin binder containing a graft copolymer obtained by graft-copolymerizing a polyester resin with a polymerizable vinyl monomer, a wax and a specific wax stabilizer.

In addition, Patent Literature 2 discloses a binder obtained by mixing a mixture (a) of raw material monomers to be subjected to two polymerization reaction systems having respective reaction paths that are independent of each other, a compound (b) capable of reacting with both of the raw material monomers to be subjected to the two polymerization reaction systems, and a releasing agent (c), and subjecting the resulting mixture to the two polymerization reactions in a common reaction vessel.

CITATION LIST

Patent Literatures

Patent Literature 1; JP 2012-88345A
Patent Literature 2: JP 10-87839A

SUMMARY OF THE INVENTION

The present invention relates to the following aspects [1] to [4]. [1] A resin binder composition for toners for development of electrostatic images including a polyester-based resin and a polypropylene-based wax (W-1), in which the resin binder composition has an endothermic amount ratio $\Delta H_{CW/W}$ of not less than 0.10 and not more than 0.80, the endothermic amount ratio $\Delta H_{CW/W}$ being represented by the following formula (1);

$$\text{Endothermic Amount Ratio } \Delta H_{CW/W} = \Delta H_{CW}/\Delta H_W \quad (1)$$

wherein $\Delta H_{CW}$ is an endothermic amount of a melting endothermic peak per 1 g of the polypropylene-based wax (W-1) as measured with respect to the resin binder composition; and $\Delta H_W$ is an endothermic amount of a melting endothermic peak per 1 g of the polypropylene-based wax (W-1) as measured with respect to the polypropylene-based wax (W-1) singly, $\Delta H_{CW}$ and $\Delta H_W$ each representing an endothermic amount as measured at a temperature rise rate of 10° C./min using a differential scanning calorimeter.

[2] A resin binder composition for toners for development of electrostatic images including a polyester-based resin and a polypropylene-based wax (W-1), in which the polypropylene-based wax (W-1) is dispersed in the polyester-based resin;

a volume-median particle size ($D_{50}$) of the wax as a whole as measured by a dynamic light scattering method using a dispersion H prepared by the following Method 1 is not less than 1 μm and not more than 50 μm;

a volume-median particle size ($D_{50}$) of a small particle size component of the wax as measured by a dynamic light scattering method using a dispersion S of the small particle size component of the wax which is prepared by the following Method 2 is not less than 20 nm and not more than 400 nm; and a content of the small particle size component of the wax is not less than 20% by mass and not more than 90% by mass on the basis of a total amount of the wax in the dispersion H, Method 1: 1 part by mass of the resin binder composition and 30 parts by mass of methyl ethyl ketone are stirred for 1 hour to prepare the dispersion H; and Method 2: after stirring the dispersion prepared by the aforementioned Method 1, the dispersion is allowed to stand for 24 hours to precipitate a large particle size component of the wax and separate a supernatant solution therefrom, thereby obtaining the dispersion S of the small particle size component of the wax.

[3] A process for producing a resin binder composition for toners for development of electrostatic images, including the following steps 1B-1 and 1B-2 in which a polypropylene-based wax (W-1) is added to a reaction system prior to addition polymerization of the step 1B-2:

Step 1B-1: subjecting an alcohol component and a carboxylic acid component to polycondensation to produce a polyester-based resin segment (A); and Step 1B-2: subjecting a vinyl-based monomer to addition polymerization to produce a vinyl-based resin segment (B).

[4] A toner for development of electrostatic images including the resin binder composition according to the above aspect [1] or [2].

DETAILED DESCRIPTION OF THE INVENTION

However, it has been supposed that these conventionally developed toners are basically applied to a paper as a printing medium. The paper is quite different in characteristics as the printing medium such as polarity or surface conditions of the material from those of polypropylene. For this reason, the conventionally developed toners have such a problem that they are hardly fused onto a polypropylene (hereinafter also referred to merely as "PP") film.

The present invention aims at providing a resin binder composition for toners for development of electrostatic images which is capable of obtaining a toner that is excellent in fusing properties to a PP film, a process for producing the resin binder composition, and a toner for development of electrostatic images which includes the resin binder composition.

The present inventors have found that by incorporating a polypropylene-based wax into a polyester-based resin and controlling an endothermic amount ratio $\Delta H_{CW/W}$ of the resulting composition to a specific range, it is possible to obtain a resin binder composition for toners for development of electrostatic images which is capable of obtaining a toner that is excellent in fusing properties to a PP film.

That is, the present invention relates to the following aspects [1] to [4].

[1] A resin binder composition for toners for development of electrostatic images including a polyester-based resin and a polypropylene-based wax (W-1), in which the resin binder composition has an endothermic amount ratio $\Delta H_{CW/W}$ of not less than 0.10 and not more than 0.80, the endothermic amount ratio $\Delta H_{CW/W}$ being represented by the following formula (1):

$$\text{Endothermic Amount Ratio } \Delta H_{CW/W}=\Delta H_{CW}/\Delta H_W \quad (1)$$

wherein $\Delta H_{CW}$ is an endothermic amount of a melting endothermic peak per 1 g of the polypropylene-based wax (W-1) as measured with respect to the resin binder composition; and $\Delta H_W$ is an endothermic amount of a melting endothermic peak per 1 g of the polypropylene-based wax (W-1) as measured with respect to the polypropylene-based wax (W-1) singly, $\Delta H_{CW}$ and $\Delta H_W$ each representing an endothermic amount as measured at a temperature rise rate of 10° C./min using a differential scanning calorimeter.

[2] A resin binder composition for toners for development of electrostatic images including a polyester-based resin and a polypropylene-based wax (W-1), in which the polypropylene-based wax (W-1) is dispersed in the polyester-based resin;

a volume-median particle size ($D_{50}$) of the wax as a whole as measured by a dynamic light scattering method using a dispersion H prepared by the following Method 1 is not less than 1 μm and not more than 50 μm;

a volume-median particle size ($D_{50}$) of a small particle size component of the wax as measured by a dynamic light scattering method using a dispersion S of the small particle size component of the wax which is prepared by the following Method 2 is not less than 20 nm and not more than 400 nm; and a content of the small particle size component of the wax is not less than 20% by mass and not more than 90% by mass on the basis of a total amount of the wax in the dispersion H, Method 1: 1 part by mass of the resin binder composition and 30 parts by mass of methyl ethyl ketone are stirred for 1 hour to prepare the dispersion H; and Method 2: after stirring the dispersion prepared by the aforementioned Method 1, the dispersion is allowed to stand for 24 hours to precipitate a large particle size component of the wax and separate a supernatant solution therefrom, thereby obtaining the dispersion S of the small particle size component of the wax.

[3] A process for producing a resin binder composition for toners for development of electrostatic images, including the following steps 1B-1 and 1B-2 in which a polypropylene-based wax (W-1) is added to a reaction system prior to addition polymerization of the step 1B-2:

Step 1B-1; subjecting an alcohol component and a carboxylic acid component to polycondensation to produce a polyester-based resin segment (A); and Step 1B-2: subjecting a vinyl-based monomer to addition polymerization to produce a vinyl-based resin segment (B).

[4] A toner for development of electrostatic images including the resin binder composition according to the above aspect [1] or [2].

In accordance with the present invention, there are provided a resin binder composition for toners for development of electrostatic images which is capable of obtaining a toner that is excellent in fusing properties to a PP film, a process for producing the resin binder composition, and a toner for development of electrostatic images which includes the resin binder composition.

Moreover, in accordance with the present invention, there are provided a resin binder composition for toners for development of electrostatic images which is capable of obtaining a toner that is excellent in not only fusing properties to a PP film, but also transparency of the resulting printed material, a process for producing the resin binder composition, and a toner for development of electrostatic images which includes the resin binder composition.

[Resin Binder Composition for Toners for Development of Electrostatic Images]

In an embodiment of the present invention, the resin binder composition for toners for development of electrostatic images includes a polyester-based resin and a polypropylene-based wax (W-1), in which the resin binder composition has an endothermic amount ratio $\Delta H_{CW/W}$ of not less than 0.10 and not more than 0.80, the endothermic amount ratio $\Delta H_{CW/W}$ being represented by the following formula (1);

$$\text{Endothermic Amount Ratio } \Delta H_{CW/W}=\Delta H_{CW}/\Delta H_W \quad (1)$$

wherein $\Delta H_{CW}$ is an endothermic amount of a melting endothermic peak per 1 g of the polypropylene-based wax (W-1) as measured with respect to the resin binder composition; and $\Delta H_W$ is an endothermic amount of a melting endothermic peak per 1 g of the polypropylene-based wax (W-1) as measured with respect to the polypropylene-based wax (W-1) singly, $\Delta H_{CW}$ and $\Delta H_W$ each representing an endothermic amount as measured at a temperature rise rate of 10° C./min using a differential scanning calorimeter.

The reason why a toner for development of electrostatic images (hereinafter also referred to merely as a "toner") which is excellent in fusing properties to a PP film can be obtained from the resin binder composition for toners for development of electrostatic images according to the present invention (hereinafter also referred to merely as a "resin binder composition") is considered as follows, though it is not clearly determined yet.

The resin binder composition of the present invention is characterized by including a polypropylene-based wax (W-1), and having an endothermic amount ratio $\Delta H_{CW/W}$ represented by the aforementioned formula (1) which falls in the range of not less than 0.10 and not more than 0.80.

The endothermic amount ratio $\Delta H_{CW/W}$ represents the condition of crystallization of the wax in the polyester-based resin. As the endothermic amount ratio $\Delta H_{CW/W}$ becomes closer to the aforementioned upper limit, it is shown that the degree of crystallization of the wax in the polyester-based resin is increased. Whereas, as the endothermic amount ratio $\Delta H_{CW/W}$ becomes closer to the aforementioned lower limit, it is shown that the degree of non-crystallization of the wax in the polyester-based resin is increased.

It is considered that by incorporating the non-crystalline polypropylene-based wax (W-1) in the resin binder composition, the resulting toner of the present invention can be more strongly adhered to the surface of a PP film.

In addition, in another embodiment of the present invention, the resin binder composition for toners for development of electrostatic images includes a polyester-based resin and a polypropylene-based wax (W-1), in which the polypropylene-based wax (W-1) is dispersed in the polyester-based resin;

a volume-median particle size ($D_{50}$) of the wax as a whole as measured by a dynamic light scattering method using a dispersion H prepared by the following Method 1 is not less than 1 μm and not more than 50 μm;

a volume-median particle size ($D_{50}$) of a small particle size component of the wax as measured by a dynamic light scattering method using a dispersion S of the small particle size component of the wax which is prepared by the following Method 2 is not less than 20 nm and not more than 400 nm; and a content of the small particle size component of the wax is not less than 20% by mass and not more than 90% by mass on the basis of a total amount of the wax in the dispersion H, Method 1: 1 part by mass of the resin binder composition and 30 parts by mass of methyl ethyl ketone are stirred for 1 hour to prepare the dispersion H; and Method 2: after stirring the dispersion prepared by the aforementioned Method 1, the dispersion is allowed to stand for 24 hours to precipitate a large particle size component of the wax and separate a supernatant solution therefrom, thereby obtaining the dispersion S of the small particle size component of the wax.

The reason why the toner that is excellent in fusing properties to a PP film can be obtained from the resin binder composition according to the present invention is considered as follows, though it is not clearly determined yet.

The present inventors have noticed a particle size of the wax dispersed in the resin binder composition.

When mixing the resin binder composition with methyl ethyl ketone and stirring the resulting mixture for 1 hour, the polyester-based resin contained in the resin binder composition is dissolved in methyl ethyl ketone, so that it is possible to obtain a dispersion H well reflecting the particle size of the wax dispersed in the resin binder composition.

Also, when controlling a volume median particle size ($D_{50}$) of the whole wax particles contained in the dispersion H to the range of not less than 1 μm and not more than 50 μm as measured by a dynamic light scattering method, the wax is capable of forming a domain having an adequate size in the resin binder composition. For this reason, the toner including such a resin binder composition is excellent in fusing properties to a PP film.

Furthermore, when allowing the dispersion H to stand for 24 hours to precipitate a large particle size component of the wax and thereby separate a small particle size component of the wax only from the dispersion H, the volume median particle size of the small particle size component of the wax as observed falls within the range of not less than 20 nm and not more than 400 nm. Besides, when calculating a content (% by mass) of the small particle size component of the wax to study the relationship to properties of the resulting toner, it becomes apparent that the content of the small particle size component of the wax has a correlation with transparency of the resulting printed film material.

Meanwhile, in a method of measuring a particle size of the wax by a dynamic light scattering method, in the case where the wax in the dispersion to be measured contains a large particle size component having a particle size of not less than 1 μm, the particle size of the small particle size component of the wax which falls in the range of not less than 20 nm and not more than 400 nm is hardly reflected on the measured values, so that it is difficult to measure a content of the small particle size component of the wax which can accurately reflect an actual condition of the dispersion. That is, by actually fractionating the large particle size component and the small particle size component of the wax from each other by the Method 2, the content of the small particle size component of the wax can be clearly determined. Thus, according to the present invention, the aforementioned knowledge has been newly found.

More specifically, in the case where the content of the small particle size component of the wax having a particle size of not less than 20 nm and not more than 400 nm which is dispersed in the resin binder composition is increased, it is possible to enhance transparency of the resulting printed film material. The reason why the aforementioned advantage can be attained by the present invention is considered to be that since the small particle size component of the wax is maintained in a highly dispersed state in the resin binder composition even after printing, the toner including the resin binder composition can be fixed on a PP film while keeping its high transparency, so that the resulting printed material can exhibit much higher transparency.

<$\Delta H_{CW/W}$>

The endothermic amount ratio $\Delta H_{CW/W}$ is not less than 0.10, preferably not less than 0.20, more preferably not less than 0.30, even more preferably not less than 0.40 and further even more preferably not less than 0.45 from the viewpoint of attaining good heat resistance and storage stability of the resulting toner, and is also not more than 0.80, preferably not more than 0.70, more preferably not more than 0.60, even more preferably not more than 0.55 and further even more preferably not more than 0.50 from the viewpoint of improving fusing properties of the resulting toner to a PP film and enhancing transparency of the resulting printed material.

$\Delta H_{CW/W}$ may be determined by the method described in Examples below. Also, in the case where the polypropylene-based wax (W-1) contained in the resin binder composition of the present invention is in the form of a mixture of two or more kinds of polypropylene-based waxes (W-1), the aforementioned $\Delta H_{CW}$ and $\Delta H_{W}$ of the polypropylene-based wax (W-1) represent the respective endothermic amounts of melting endothermic peaks measured with respect to the mixture containing the two or more kinds of polypropylene-based waxes (W-1).

The aforementioned $\Delta H_{CW/W}$ may be appropriately adjusted to a specific range from the viewpoint of well controlling the degree of crystallization of the resin binder composition as desired. For example, $\Delta H_{CW/W}$ may be suitably controlled by the method described in the present specification, a method of using a wax containing a hydroxy group or an acid group in combination therewith, a method of using a sterol in combination therewith, etc.

<Dispersing Condition of Polypropylene-Based Wax (W-1)>

The polypropylene-based wax (W-1) is dispersed in the polyester-based resin.

The particle size of the polypropylene-based wax (W-1) dispersed is specifically determined by using the following Method 1 and Method 2.

Method 1: One part by mass of the resin binder composition and 30 parts by mass of methyl ethyl ketone are stirred for 1 hour to prepare the dispersion H.

Method 2: After stirring the dispersion prepared by the aforementioned Method 1, the dispersion is allowed to stand for 24 hours to precipitate the large particle size component of the wax and separate a supernatant solution therefrom to thereby obtain the dispersion S of the small particle size component of the wax.

Meanwhile, the aforementioned resin binder composition contains the polyester-based resin and the wax. The detailed conditions of Method 1 and Method 2 are the same as those described in Examples below.

The volume median particle size ($D_{50}$) of the wax as a whole as measuring by a dynamic light scattering method using the dispersion H obtained by Method 1 (hereinafter also referred to merely as a "volume median particle size of the wax as a whole") is not less than 1 μm and not more than 50 μm from the viewpoint of attaining excellent fusing properties of the resulting toner to a PP film.

The volume median particle size of the wax as a whole is preferably not less than 3 μm, more preferably not less than 5 μm and even more preferably not less than 8 μm, and is also preferably not more than 40 μm, more preferably not more than 35 μm, even more preferably not more than 30 μm, further even more preferably not more than 25 μm and still further even more preferably not more than 20 μm, from the viewpoint of improving fusing properties of the resulting toner to a PP film.

The volume median particle size ($D_{50}$) of the small particle size component of the wax as measured by a dynamic light scattering method using the dispersion S of the small particle size component of the wax which is prepared by Method 2 (hereinafter also referred to merely as a "volume median particle size of the small particle size component") is not less than 20 nm and not more than 400 nm from the viewpoint of obtaining a toner that is capable of producing a printed material having excellent transparency.

The volume median particle size of the small particle size component of the wax is preferably not less than 60 nm, more preferably not less than 100 nm and even more preferably not less than 120 nm, and is also preferably not more than 300 nm, more preferably not more than 250 nm, even more preferably not more than 200 nm and further even more preferably not more than 160 nm, from the viewpoint of improving transparency of the resulting printed material.

The content of the small particle size component of the wax in the resin binder composition is not less than 20% by mass and not more than 90% by mass on the basis of a total amount of the wax contained in the dispersion H from the viewpoint of attaining excellent fusing properties of the resulting toner to a PP film as well as from the viewpoint of obtaining a toner that is capable of producing a printed material having excellent transparency.

The content of the small particle size component of the wax in the resin binder composition is preferably not less than 30% by mass, more preferably not less than 35% by mass, even more preferably not less than 40% by mass, further even more preferably not less than 46% by mass and still further even more preferably not less than 50% by mass, and is also preferably not more than 85% by mass, more preferably not more than 80% by mass and even more preferably not more than 70% by mass, on the basis of a total amount of the wax contained in the dispersion H, from the viewpoint of attaining excellent fusing properties of the resulting toner to a PP film.

The content of the small particle size component of the wax is the value obtained by the method described in Examples below. Meanwhile, the total amount of the wax contained in the dispersion H means a total amount of the large particle size component and the small particle size component of the wax which are obtained in Method 2.

The content of the small particle size component of the wax in the resin binder composition is preferably not less than 1.0 part by mass, more preferably not less than 1.5 parts by mass, even more preferably not less than 2.0 parts by mass and further even more preferably not less than 2.5 parts by mass, and is also preferably not more than 54 parts by mass, more preferably not more than 40 parts by mass and even more preferably not more than 30 parts by mass, on the basis of 100 parts by mass of the resin binder, from the viewpoint of attaining excellent fusing properties of the resulting toner to a PP film.

The content of the large particle size component of the wax in the resin binder composition is preferably not less than 10% by mass, more preferably not less than 15% by mass and even more preferably not less than 20% by mass on the basis of a total amount of the wax contained in the dispersion H from the viewpoint of improving fusing properties of the resulting toner to a PP film, and is also preferably not more than 80% by mass, more preferably not more than 70% by mass and even more preferably not more than 60% by mass on the basis of a total amount of the wax contained in the dispersion H from the viewpoint of enhancing transparency of the resulting printed material.

The content of the large particle size component of the wax is the value obtained by the method described in Examples below.

In the following, the respective components of the resin binder composition according to the present invention is described in more details.

<Polypropylene-Based Wax (W-1)>

The resin binder composition of the present invention contains the polypropylene-based wax (W-1) from the viewpoint of attaining excellent fusing properties of the resulting toner to a PP film and enhancing transparency of the resulting printed material. Meanwhile, the polypropylene-based wax (W-1) may be used in combination with any conventionally known waxes unless the advantageous effects of the present invention are adversely affected by the use thereof.

The polypropylene-based wax (W-1) used in the present invention is not particularly limited. Examples of the polypropylene-based wax (W-1) include polypropylene waxes obtained by a general method of polymerizing a propylene, a method of subjecting a polypropylene used in a general molding method for forming containers, etc., to a thermal decomposition, a method of separating and purifying a lower-molecular weight polypropylene that is by-produced upon production of a polypropylene used in a general molding method for forming containers, etc., and derivatives of these polypropylene waxes. Examples of the derivatives of the polypropylene waxes include oxides of the polypropylene waxes, i.e., those oxidized polypropylene waxes prepared by adding and introducing a carboxy group or a hydroxy group, etc., into a polypropylene wax skeleton by an air oxidation method or the like, as well as modified products of the polypropylene waxes such as maleic acid-modified polypropylene waxes, fumaric acid-modified polypropylene waxes, itaconic acid-modified polypropylene waxes and styrene-modified polypropylene waxes. Among these polypropylene-based waxes, preferred is at least one wax selected from the group consisting of the polypropylene waxes and the maleic acid-modified polypropylene waxes, and more preferred are the polypropylene waxes.

The melting point of the polypropylene-based wax (W-1) is preferably not lower than 90° C., more preferably not lower than 100° C. and even more preferably not lower than 110° C., and is also preferably not higher than 170° C., more preferably not higher than 160° C., even more preferably not higher than 150° C. and further even more preferably not higher than 140° C., from the viewpoint of attaining excellent fusing properties of the resulting toner to a PP film.

The acid value of the polypropylene-based wax (W-1) is preferably not more than 70 mgKOH/g, more preferably not more than 30 mgKOH/g, even more preferably not more than 10 mgKOH/g and further even more preferably not more than 2 mgKOH/g, and is also not less than 0 mgKOH/g, from the viewpoint of improving fusing properties of the resulting toner onto a film. In addition, from the viewpoint of enhancing transparency of the resulting printed material, the acid value of the polypropylene-based wax (W-1) is furthermore preferably 0 mgKOH/g.

The hydroxy value of the polypropylene-based wax (W-1) is preferably not more than 70 mgKOH/g, more preferably not more than 30 mgKOH/g and even more preferably not more than 10 mgKOH/g, and is also not less than 0 mgKOH/g and preferably 0 mgKOH/g, from the viewpoint of improving fusing properties of the resulting toner onto a film.

Meanwhile, the details of the methods of measuring the aforementioned properties of the polypropylene-based wax (W-1) are described in Examples below.

The weight-average molecular weight of the polypropylene-based wax (W-1) is preferably not less than 300, more preferably not less than 500 and even more preferably not less than 700 from the viewpoint of obtaining a toner having excellent heat resistance and storage stability, and is also preferably not more than 50,000, more preferably not more than 30,000, even more preferably not more than 15,000, further even more preferably not more than 8,000, still further even more preferably not more than 5,000, still further even more preferably not more than 3,000 and still further even more preferably not more than 1,000 from the viewpoint of improving fusing properties of the resulting toner to a PP film. The weight-average molecular weight of the polypropylene-based wax (W-1) may be measured by gel permeation chromatography using polystyrene as a reference standard sample.

The content of the polypropylene-based wax (W-1) in the resin binder composition is preferably not less than 1 part by mass, more preferably not less than 3 parts by mass, even more preferably not less than 5 parts by mass, further even more preferably not less than 7 parts by mass and still further even more preferably not less than 10 parts by mass on the basis of 100 parts by mass of the resin binder from the viewpoint of improving fusing properties of the resulting toner to a PP film, and is also preferably not more than 60 parts by mass, more preferably not more than 50 parts by mass, even more preferably not more than 40 parts by mass and further even more preferably not more than 30 parts by mass on the basis of 100 parts by mass of the resin binder from the viewpoint of improving fusing properties of the resulting toner to a PP film and enhancing transparency of the resulting printed material.

In addition, the content of the polypropylene-based wax (W-1) in the resin binder composition is preferably not less than 1 part by mass, more preferably not less than 3 parts by mass, even more preferably not less than 5 parts by mass, further even more preferably not less than 7 parts by mass and still further even more preferably not less than 10 parts by mass on the basis of 100 parts by mass of the polyester-based resin from the viewpoint of improving fusing properties of the resulting toner to a PP film, and is also preferably not more than 60 parts by mass, more preferably not more than 50 parts by mass, even more preferably not more than 40 parts by mass and further even more preferably not more than 30 parts by mass on the basis of 100 parts by mass of the polyester-based resin from the viewpoint of improving fusing properties of the resulting toner to a PP film and enhancing transparency of the resulting printed material.

The content of the polypropylene-based wax (W-1) in the whole wax components contained in the resin binder composition is preferably not less than 80% by mass, more preferably not less than 90% by mass and even more preferably not less than 95% by mass, and is also not more than 100% by mass, and furthermore preferably 100% by mass, from the viewpoint of improving fusing properties of the resulting toner to a PP film and enhancing transparency of the resulting printed material.

<Polyester-Based Resin>

The polyester-based resin used in the present invention is not particularly limited as long as it is in the form of a polyester-based resin containing at least a constitutional unit obtained by polycondensing an alcohol component and a carboxylic acid component. In addition, the polyester-based resin used in the present invention may also include not only the aforementioned polyester-based resin, but also a modified polyester-based resin that is obtained by modifying the polyester-based resin to such an extent that the modification gives substantially no adverse influence on properties of the resin.

Examples of the modified polyester-based resin include a urethane-modified polyester-based resin that is obtained by modifying the polyester-based resin with a urethane bond, an epoxy-modified polyester-based resin that is obtained by modifying the polyester-based resin with an epoxy bond, a composite resin (HB) containing a polyester-based resin segment (A) and a vinyl-based resin segment (B), and the like. Of these modified polyester-based resins, from the viewpoint of improving fusing properties of the resulting toner to a PP film, preferred is the composite resin (HB) containing the polyester-based resin segment (A) and the vinyl-based resin segment (B).

In addition, as the polyester-based resin, from the viewpoint of enhancing hydrophobic properties thereof and improving affinity thereof to the polypropylene-based wax (W-1) to thereby promote non-crystallization of the polypropylene-based wax (W-1) and improve fusing properties of the resulting toner to a PP film, preferred is at least one polyester-based resin selected from the group consisting of:

(a) a composite resin (HB) containing a polyester-based resin segment (A) and a vinyl-based resin segment (B) containing a constitutional unit derived from a vinyl-based monomer;

(b) a polyester-based resin containing a constitutional unit derived from a hydrocarbon wax (W-2) having a number-average molecular weight of not less than 400 in which a sum of an acid value and a hydroxy value thereof is not less than 40 mgKOH/g (hereinafter also referred to merely as a "hydrocarbon wax (W-2)"); and (c) a polyester-based resin containing a constitutional unit derived from a sterol.

The resin "containing a constitutional unit" as used in the present specification means a resin in which a specific constitutional unit is bonded to a polymer structure of the resin through a covalent bond.

<<Alcohol Component>>

Examples of the alcohol component include an aliphatic diol, an aromatic diol and a trivalent or higher-valent polyhydric alcohol. These alcohol components may be used alone or in combination of any two or more thereof.

The alcohol component preferably includes an alkylene-oxide adduct of bisphenol A represented by the following formula (I) from the viewpoint of improving fusing properties of the resulting toner to a PP film:

(I)

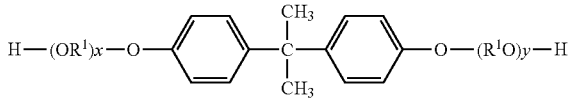

wherein $R^1$ is an alkylene group having 2 or 3 carbon atoms; and x and y are respectively a positive number representing an average molar number of addition of an alkyleneoxide, and a sum of x and y is preferably not less than 1, more preferably not less than 1.5 and even more preferably not less than 2, and is also preferably not more than 16, more preferably not more than 5 and even more preferably not more than 3.

Examples of the alkyleneoxide adduct of bisphenol A represented by the aforementioned formula (I) include a polyoxypropylene adduct of 2,2-bis(4-hydroxyphenyl)propane and a polyoxyethylene adduct of 2,2-bis(4-hydroxyphenyl)propane.

The content of the polyoxypropylene adduct of 2,2-bis(4-hydroxyphenyl)propane in the alcohol component as a raw material monomer of the polyester-based resin is preferably not less than 50 mol %, more preferably not less than 60 mol % and even more preferably not less than 65 mol %, and is also preferably not more than 100 mol %, more preferably not more than 85 mol % and even more preferably not more than 75 mol %, from the viewpoint of improving fusing properties of the resulting toner to a PP film.

The content of the alkyleneoxide adduct of bisphenol A represented by the aforementioned formula (I) in the alcohol component as a raw material monomer of the polyester-based resin is preferably not less than 80 mol %, more preferably not less than 85 mol % and even more preferably not less than 90 mol %, and is also not more than 100 mol %, and furthermore preferably 100 mol %, from the viewpoint of improving fusing properties of the resulting toner to a PP film.

In addition, the alcohol component may also contain, for example, an aliphatic diol having not less than 2 and not more than 20 carbon atoms or a trivalent or higher-valent polyhydric alcohol such as glycerin, etc. Examples of the aliphatic diols include ethylene glycol, 1,2-propanediol, 1,3-propanediol, 1,4-butanediol, 1,5-pentanediol, 1,6-hexanediol, 1,4-butenediol, 1,3-butanediol, neopentyl glycol, 1,10-decanediol and 1,12-dodecanediol. Among these aliphatic olio's, preferred is 1,2-propanediol.

<<Carboxylic Acid Component>>

Examples of the carboxylic acid component include an aliphatic dicarboxylic acid, an aromatic dicarboxylic acid and a trivalent or higher-valent polycarboxylic acid, as well as an anhydride and an alkyl (having not less than 1 and not more than 3 carbon atoms) ester of these acids. These carboxylic acid components may be used alone or in combination of any two or more kinds thereof.

The number of carbon atoms contained in a main chain of the aliphatic dicarboxylic acid is preferably not less than 4, and is also preferably not more than 16, more preferably not more than 14, even more preferably not more than 10, further even more preferably not more than 8 and still further even more preferably not more than 6, from the viewpoint of improving fusing properties of the resulting toner to a PP film.

Specific examples of the aliphatic dicarboxylic acid include oxalic acid, malonic acid, maleic acid, fumaric acid, citraconic acid, itaconic acid, glutaconic acid, succinic acid, adipic acid, sebacic acid, azelaic acid, sebacic acid and dodecanedioic acid, as well as substituted succinic acids containing an alkyl group having not less than 1 and not more than 20 carbon atoms or an alkenyl group having not less than 2 and not more than 20 carbon atoms as a substituent group, such as dodecyl succinic acid, dodecenyl succinic acid and octenyl succinic acid. Of these aliphatic dicarboxylic acids, from the viewpoint of improving fusing properties of the resulting toner to a PP film, preferred are fumaric acid, dodecenyl succinic acid and octenyl succinic acid, and more preferred is fumaric acid.

Examples of the aromatic dicarboxylic acid include terephthalic acid, phthalic acid and isophthalic acid.

Of these aromatic dicarboxylic acids, from the viewpoint of improving fusing properties of the resulting toner to a PP film, preferred is terephthalic acid.

The content of the aliphatic dicarboxylic acid in the carboxylic acid component as a raw material monomer of the polyester-based resin is preferably not less than 5 mol %, more preferably not less than 10 mol % and even more preferably not less than 20 mol %, and is also preferably not more than 40 mol %, more preferably not more than 35 mol % and even more preferably not more than 30 mol %, from the viewpoint of improving fusing properties of the resulting toner to a PP film.

In addition, the content of the aromatic dicarboxylic acid in the carboxylic acid component as a raw material monomer of the polyester-based resin is preferably not less than 50 mol %, more preferably not less than 60 mol % and even more preferably not less than 65 mol %, and is also preferably not more than 95 mol %, more preferably not more than 85 mol % and even more preferably not more than 80 mol %, from the same viewpoint as described above.

The total content of the aliphatic dicarboxylic acid and the aromatic dicarboxylic acid in the carboxylic acid component as a raw material monomer of the polyester-based resin is preferably not less than 70 mol %, more preferably not less than 80 mol % and even more preferably not less than 85 mol %, and is also not more than 100 mol %, and furthermore preferably 100 mol %, from the same viewpoint as described above.

The trivalent or higher-valent polycarboxylic acid usable in the present invention is preferably a trivalent carboxylic acid. Specific examples of the trivalent or higher-valent polycarboxylic acid include trimellitic acid, 2,5,7-naphthalene tricarboxylic acid and pyromellitic acid. Among these trivalent or higher-valent polycarboxylic acids, from the viewpoint of improving fusing properties of the resulting toner to a PP film, preferred is trimellitic acid.

The content of the trivalent or higher-valent polycarboxylic acid in the carboxylic acid component as a raw material monomer of the polyester-based resin is preferably not less than 1 mol %, more preferably not less than 5 mol % and even more preferably not less than 10 mol %, and is also preferably not more than 30 mol %, more preferably not more than 25 mol % and even more preferably not more than 20 mol %, from the viewpoint of improving fusing properties of the resulting toner to a PP film.

Of these carboxylic acid components, from the viewpoint of improving fusing properties of the resulting toner to a PP film, preferred is a combination of the aromatic dicarboxylic acid and the aliphatic dicarboxylic acid, more preferred is a combination of fumaric acid and terephthalic acid, and even more preferred is a combination of fumaric acid, terephthalic acid and trimellitic acid.

[Molar Ratio of Carboxylic Acid Component to Alcohol Component]

The molar ratio of the carboxylic acid component to the alcohol component [carboxylic acid component/alcohol component] is preferably not less than 0.7, more preferably not less than 0.8, even more preferably not less than 0.9, further even more preferably not less than 1.0 and still further even more preferably not less than 1.1, and is also preferably not more than 1.5, more preferably not more than 1.4 and even more preferably not more than 1.3, from the viewpoint of well controlling reactivity of these components and properties of the resulting polyester-based resin.

Meanwhile, from the viewpoint of well controlling properties of the resulting polyester-based resin, the alcohol component may also contain an appropriate amount of a monovalent alcohol, and the carboxylic acid component may also contain an appropriate amount of a monovalent carboxylic acid compound.

The equivalent ratio of a COOH group of the carboxylic acid component to a OH group of the alcohol component [COOH group/OH group] is preferably not less than 0.7, more preferably not less than 0.8, even more preferably not less than 0.9, further even more preferably not less than 1.0 and still further even more preferably not less than 1.1, and is also preferably not more than 1.5, more preferably not more than 1.4 and even more preferably not more than 1.3, from the viewpoint of well controlling reactivity of these components and properties of the resulting polyester-based resin.

((a) Composite Resin (HB))

The composite resin (HB) preferably contains three constitutional moieties including a polyester-based resin segment (A), a vinyl-based resin segment (B) and a constitutional moiety derived from a bireactive monomer that is capable of reacting with both of the polyester-based resin segment (A) and the vinyl-based resin segment (B). In addition, the composite resin (HB) may also contains constitutional moieties other than the aforementioned three constitutional moieties unless the advantageous effects of the present invention are adversely affected by inclusion thereof. However, it is preferred that the composite resin (HB) contains no constitutional moieties other than the aforementioned three constitutional moieties.

The mass ratio of the polyester-based resin segment (A) to the vinyl-based resin segment (B) [(A)/(B)] in the composite resin (HB) is preferably not less than 40/60, more preferably not less than 50/50 and even more preferably not less than 55/45, and is also preferably not more than 95/5, more preferably not more than 80/20 and even more preferably not more than 70/30, from the viewpoint of improving fusing properties of the resulting toner to a PP film.

Meanwhile, when calculating the aforementioned mass ratio, the value obtained by subtracting an amount of water removed upon the condensation reaction from a total amount of the raw material monomers of the polyester-based resin segment (A) is used as the mass of the polyester-based resin segment (A), whereas the total amount of the raw material monomer of the vinyl-based resin segment (B) and a polymerization initiator is used as the mass of the vinyl-based resin segment (B). In addition, an amount of the bireactive monomer that may be optionally used, if required, is calculated as being included in the mass of the polyester-based resin segment (A).

The total content of the polyester-based resin segment (A), the vinyl-based resin segment (B) and the constitutional unit derived from the bireactive monomer in the composite resin (HB) is preferably not less than 90 mol %, more preferably not less than 95 mol % and even more preferably not less than 99 mol %, and is also not more than 100 mol %, and furthermore preferably 100 mol %, from the viewpoint of improving fusing properties of the resulting toner to a PP film

[Polyester-Based Resin Segment (A)]

The polyester-based resin constituting the polyester-based resin segment (A) is not particularly limited as long as it is a polyester-based resin for toners which has properties used for ordinary toners, etc. As the polyester-based resin, there are preferably used the aforementioned polyester-based resins that are obtained by polycondensing the alcohol component and the carboxylic acid component.

[Vinyl-Based Resin Segment (B)]

From the viewpoint of finely dispersing and stabilizing the polypropylene-based wax (W-1) in the resin binder composition to thereby improve fusing properties of the resulting toner to a PP film, the vinyl-based resin segment (B) contains a constitutional unit derived from a vinyl-based monomer, preferably contains a constitutional unit derived from a vinyl-based monomer containing an alkyl group having not less than 6 and not more than 22 carbon atoms, and more preferably contains a constitutional unit derived from a vinyl-based monomer containing an alkyl group having not less than 6 and not more than 22 carbon atoms and a constitutional unit derived from a styrene compound. More specifically, the raw material vinyl-based monomer of the vinyl-based resin segment (B) preferably includes a vinyl-based monomer containing an alkyl group having not less than 6 and not more than 22 carbon atoms, and more preferably includes a vinyl-based monomer containing an alkyl group having not less than 6 and not more than 22 carbon atoms and a styrene compound.

The vinyl-based resin segment (B) having a hydrophobic long-chain alkyl group is capable of exhibiting enhanced affinity to the polypropylene-based wax (W-1). As a result, it is considered that the polypropylene-based wax (W-1) can be well finely dispersed in the composite resin (HB) including the vinyl-based resin segment (B).

The vinyl-based monomer containing an alkyl group having not less than 6 and not more than 22 carbon atoms is preferably a (meth)acrylic acid ester containing an alkyl group having not less than 6 and not more than 22 carbon atoms.

The number of carbon atoms contained in the alkyl group of the vinyl-based monomer containing an alkyl group having not less than 6 and not more than 22 carbon atoms is preferably not less than 6 and more preferably not less than 8. In addition, from the viewpoint of improving fusing properties of the resulting toner to a PP film and enhancing transparency of the resulting printed material, the number of carbon atoms contained in the alkyl group of the vinyl-based monomer containing an alkyl group having not less than 6 and not more than 22 carbon atoms is preferably not less than 10, more preferably not less than 11, even more preferably not less than 13 and further even more preferably not less than 15, and is also preferably not more than 22, more preferably not more than 20 and even more preferably not more than 19.

The vinyl-based monomer containing an alkyl group having not less than 6 and not more than 22 carbon atoms is preferably at least one monomer selected from the group consisting of stearyl (meth)acrylate, palmityl (meth)acrylate and lauryl (meth)acrylate, more preferably at least one monomer selected from the group consisting of stearyl (meth)acrylate and palmityl (meth)acrylate, and even more preferably stearyl (meth)acrylate from the viewpoint of improving fusing properties of the resulting toner to a PP film and enhancing transparency of the resulting printed material.

As the raw material vinyl-based monomer of the vinyl-based resin segment (B), the vinyl-based monomer containing an alkyl group having not less than 6 and not more than 22 carbon atoms may be used in combination with the other vinyl-based monomers.

Examples of the other vinyl-based monomers include styrene compounds such as styrene and α-methyl styrene; ethylenically unsaturated monoolefins such as ethylene and propylene; diolefins such as butadiene; halovinyl compounds such as vinyl chloride; vinyl esters such as vinyl acetate and vinyl propionate; ethylenically monocarboxylic acid esters such as dimethylaminoethyl (meth)acrylate; vinyl ethers such as vinyl methyl ether; vinylidene halides such as vinylidene chloride; and N-vinyl compounds such as N-vinyl pyrrolidone. Of these other vinyl monomers, from the viewpoint of improving reactivity of the resin, preferred are styrene compounds, and more preferred is styrene.

The content of the constitutional unit derived from the vinyl-based monomer containing an alkyl group having not less than 6 and not more than 22 carbon atoms in the vinyl-based resin segment (B) is preferably not less than 1% by mass, more preferably not less than 5% by mass, even more preferably not less than 10% by mass and further even more preferably not less than 15% by mass from the viewpoint of improving fusing properties of the resulting toner to a PP film and enhancing transparency of the resulting printed material, and is also preferably not more than 70% by mass, more preferably not more than 60% by mass, even more preferably not more than 50% by mass and further even more preferably not more than 30% by mass from the viewpoint of enhancing transparency of the resulting printed material.

The content of the constitutional unit derived from the styrene compound in the vinyl-based resin segment (B) is preferably not less than 30% by mass, more preferably not less than 60% by mass and even more preferably not less than 70% by mass, and is also preferably not more than 99% by mass, more preferably not more than 90% by mass and even more preferably not more than 85% by mass, from the viewpoint of improving fusing properties of the resulting toner to a PP film.

The total content of the constitutional unit derived from the vinyl-based monomer containing an alkyl group having not less than 6 and not more than 22 carbon atoms and the constitutional unit derived from the styrene compound in the vinyl-based resin segment (B) is preferably not less than 90% by mass, more preferably not less than 95% by mass and even more preferably not less than 99% by mass, and is also not more than 100% by mass, and furthermore preferably 100% by mass, from the viewpoint of improving fusing properties of the resulting toner to a PP film.

The mass ratio of the polypropylene-based wax (W-1) to the constitutional unit derived from the vinyl-based monomer containing an alkyl group having not less than 6 and not more than 22 carbon atoms (W-1/vinyl-based monomer containing an alkyl group having not less than 6 and not more than 22 carbon atoms) in the composite resin is preferably not less than 0.5, more preferably not less than 0.8 and even more preferably not less than 1.0, and is also preferably not more than 6, more preferably not more than 5 and even more preferably not more than 4, from the viewpoint of improving fusing properties of the resulting toner to a PP film.

(Bireactive Monomer)

The composite resin (HB) preferably further contains a constitutional unit derived from a bireactive monomer.

When using the bireactive monomer as a raw material monomer of the composite resin (HB), the bireactive monomer is reacted with both of the the polyester-based resin segment (A) and the vinyl-based resin segment (B) to thereby produce the composite resin (HB) with good efficiency.

More specifically, the composite resin (HB) used in the present invention is preferably produced by polymerizing the raw material monomers of the polyester-based resin segment (A), the raw material monomer of the vinyl-based resin segment (B) and the bireactive monomer. The thus produced composite resin (HB) has such a structure that the polyester-based resin segment (A) and the vinyl-based resin segment (B) are bonded to each other through the constitutional unit derived from the bireactive monomer. As a result, the polyester-based resin segment (A) and the vinyl-based resin segment (B) are uniformly dispersed in the composite resin, so that the resulting toner can be suitably improved in fusing properties to a PP film.

As the bireactive monomer, there may be used those compounds containing at least one functional group selected from the group consisting of a carboxy group, a hydroxy group, an epoxy group, a primary amino group and a secondary amino group and an ethylenically unsaturated bond in a molecule thereof. Of these compounds, from the viewpoint of attaining good reactivity thereof, preferred are those compounds containing at least one functional group selected from the group consisting of a hydroxy group and a carboxy group and an ethylenically unsaturated bond, and more preferred are those compounds containing a carboxy group and an ethylenically unsaturated bond.

Specific examples of the bireactive monomer include acrylic acid, methacrylic acid, maleic acid and maleic anhydride, etc. Of these bireactive monomers, from the viewpoint of improving reactivity of both the polycondensation reaction and the addition polymerization reaction, preferred is acrylic acid or methacrylic acid, and more preferred is acrylic acid.

From the viewpoint of improving fusing properties of the resulting toner to a PP film, the bireactive monomer is used in an amount of preferably not less than 0.5 part by mass, more preferably not less than 1.0 part by mass and even more preferably not less than 1.5 parts by mass, and also preferably not more than 10 parts by mass, more preferably not more than 6 parts by mass and even more preferably not more than 5 parts by mass, on the basis of 100 parts by mass of the vinyl-based monomer as the raw material of the aforementioned vinyl-based resin segment (B).

((b) Polyester-Based Resin Containing Constitutional Unit Derived from Hydrocarbon Wax (W-2))

The polyester-based resin containing a constitutional unit derived from a hydrocarbon wax (W-2) preferably contains at least a constitutional unit derived from the aforementioned polyester-based resin. The polyester-based resin acts for rendering the polypropylene-based wax (W-1) non-crystallizable owing to inclusion of the constitutional unit derived from a hydrocarbon wax (W-2) therein, so that the resulting toner can be suitably improved in fusing properties to a PP film.

The polyester-based resin containing the constitutional unit derived from the hydrocarbon wax (W-2) is preferably obtained by polycondensing the hydrocarbon wax (W-2), the alcohol component and the carboxylic acid component.

(Hydrocarbon Wax (W-2))

The hydrocarbon wax (W-2) is not particularly limited, and preferably contains either one or both of a hydroxy group and a carboxy group. However, from the viewpoint of improving reactivity with the polyester-based resin as well as from the viewpoint of improving fusing properties of the resulting toner to a PP film, it is preferred that the hydrocarbon wax (W-2) contains both of a hydroxy group and a carboxy group.

In addition, although the hydrocarbon wax containing a hydroxy group may be used simultaneously with the hydrocarbon wax containing a carboxy group, from the viewpoint of improving reactivity of the polycondensation reaction, it is preferred that the hydrocarbon wax containing a hydroxy group is used solely.

The hydroxy group-containing hydrocarbon wax (W-2) may be produced, for example, by modifying a hydrocarbon wax such as a paraffin wax, a Fischer-Tropsch wax, a microcrystalline wax and a polyethylene wax by subjecting the hydrocarbon wax to oxidation treatment. The oxidation treatment may be conducted, for example, by the methods described in JP 62-79267A, JP 2010-197979A, etc. More specifically, the oxidation treatment is conducted by the method of subjecting the hydrocarbon wax to liquid phase oxidation with an oxygen-containing gas in the presence of boric acid.

Examples of commercially available products of the hydroxy group-containing hydrocarbon wax (W-2) include "UNILIN 700", "UNILIN 425" and "UNILIN 550" all available from BAKER PETROLITE Corporation, "Paracohol 6420", "Paracohol 6470" and "Paracohol 6490" all available from Nippon Seiro Co., Ltd., etc.

The hydroxy value of the hydroxy group-containing hydrocarbon wax (W-2) is preferably not less than 40 mgKOH/g, more preferably not less than 55 mgKOH/g and even more preferably not less than 65 mgKOH/g, and is also preferably not more than 180 mgKOH/g, more preferably not more than 150 mgKOH/g, even more preferably not more than 120 mgKOH/g and further even more preferably not more than 110 mgKOH/g, from the viewpoint of improving fusing properties of the resulting toner to a PP film.

Examples of the carboxy group-containing hydrocarbon wax (W-2) includes acid-modified waxes. The carboxy group-containing hydrocarbon wax (W-2) may be produced by introducing a carboxy group into a wax such as a polyethylene wax.

Examples of the acid-modifying method include those methods described in JP 2006-328388A, JP 2007-84787A, etc. More specifically, the carboxy group may be introduced into the hydrocarbon wax by adding an organic peroxide compound (as a reaction initiator) such as dicumyl peroxide and a carboxylic acid compound to a melt of the hydrocarbon wax to conduct the reaction therebetween.

Specific examples of the hydrocarbon wax used as the reacting raw material include a paraffin wax, a Fischer-Tropsch wax, an olefin, a microcrystalline wax and a polyethylene wax. Of these hydrocarbon waxes, preferred are a paraffin wax and a Fischer-Tropsch wax. Examples of commercially available products of the paraffin wax and Fischer-Tropsch wax which may be used as the reacting raw material include "HNP-11", "HNP-9", "HNP-10", "FT-0070", "HNP-51" and "FNP-0090" all available from Nippon Seiro Co., Ltd., etc.

Examples of commercially available products of the carboxy group-containing hydrocarbon wax (W-2) include "Hi-WAX 1105A" (maleic anhydride-modified ethylene-propylene copolymer) available from Mitsui Chemicals, Inc., etc. The acid value of the carboxy group-containing hydrocarbon wax (W-2) is preferably not less than 40 mgKOH/g, more preferably not less than 50 mgKOH/g and even more preferably not less than 55 mgKOH/g from the viewpoint of improving fusing properties of the resulting toner to a PP film, and is also preferably not more than 180 mgKOH/g, more preferably not more than 150 mgKOH/g, even more preferably not more than 120 mgKOH/g and further even more preferably not more than 110 mgKOH/g from the viewpoint of improving heat resistance and storage stability of the resulting toner.

From the viewpoint of enhancing reactivity between the raw material monomers of the polyester-based resin and the hydrocarbon wax (W-2) as well as from the viewpoint of enhancing dispersibility of the polypropylene-based wax (W-1), the sum of the acid value and the hydroxy value of the hydrocarbon wax (W-2) is preferably not less than 40 mgKOH/g, more preferably not less than 60 mgKOH/g, even more preferably not less than 70 mgKOH/g and further even more preferably not less than 90 mgKOH/g, and is also preferably not more than 200 mgKOH/g, more preferably not more than 180 mgKOH/g, even more preferably not more than 160 mgKOH/g and further even more preferably not more than 140 mgKOH/g.

The melting point of the hydrocarbon wax (W-2) is preferably not lower than 60° C., more preferably not lower than 65° C. and even more preferably not lower than 70° C., and is also preferably not higher than 110° C., more preferably not higher than 90° C. and even more preferably not higher than 80° C., from the viewpoint of improving fusing properties of the resulting toner to a PP film.

The number-average molecular weight of the hydrocarbon wax (W-2) is preferably not less than 400, more preferably not less than 500 and even more preferably not less than 600, and is also preferably not more than 3000, more preferably not more than 2000 and even more preferably not more than 1000, from the viewpoint of improving fusing properties of the resulting toner to a PP film. Meanwhile, the number-average molecular weight may be measured by gel permeation chromatography using a polystyrene as a reference standard sample.

In the case where the polyester-based resin is obtained by polycondensing the hydrocarbon wax (W-2), the carboxylic acid component and the alcohol component, the amount of the hydrocarbon wax (W-2) used in the polycondensation reaction is preferably not less than 20 parts by mass, more preferably not less than 25 parts by mass and even more preferably not less than 30 parts by mass on the basis of 100 parts by mass of a total amount of the alcohol component and the carboxylic acid component from the viewpoint of improving fusing properties of the resulting toner to a PP film, and is also preferably not more than 100 parts by mass, more preferably not more than 80 parts by mass and even more preferably not more than 50 parts by mass on the basis of 100 parts by mass of a total amount of the alcohol component and the carboxylic acid component from the viewpoint of obtaining a toner that is excellent in heat resistance and storage stability and fusing properties to a PP film. The mass ratio of the polypropylene-based wax (W-1) to the hydrocarbon wax (W-2) used as the raw material of the polyester-based resin is preferably not less than 0.1, more preferably not less than 0.3 and even more preferably not less than 0.5, and is also preferably not more than 1.2, more preferably not more than 1.0 and even more preferably not more than 0.8, from the viewpoint of improving fusing properties of the resulting toner to a PP film.

((c) Polyester-Based Resin Containing Constitutional Unit Derived from Sterol)

The polyester-based resin containing a constitutional unit derived from a sterol preferably contains at least a constitutional unit derived from the aforementioned polyester-based resin. The polyester-based resin acts for rendering the polypropylene-based wax (W-1) non-crystallizable owing to inclusion of the constitutional unit derived from a sterol therein, so that the resulting toner can be suitably improved in fusing properties to a PP film.

The polyester-based resin containing the constitutional unit derived from a sterol is preferably obtained by polycondensing the sterol, the alcohol component and the carboxylic acid component.

(Sterol)

Examples of the sterol include vegetable sterols (phytosterols) such as β-sitosterol, stigmasterol, brassicasterol and campesterol; animal sterols (zoosterols) such as cholesterol and lanosterol; and fungal sterols such as ergosterol.

The phytosterols are included in plants, in particular, those plants such as soy beans, rapeseeds, cottonseeds, tall oil, azuki beans and sugarcanes, and the phytosterols derived from soy beans are commercially available from Tama Biochemical Co., Ltd., etc. The phytosterols derived from soy beans are in the form of a mixture containing β-sitosterol as a main component as well as stigmasterol, campesterol, etc.

Of these sterols, from the viewpoint of improving fusing properties of the resulting toner to a PP film, preferred are zoosterols, and more preferred is cholesterol.

In the case where the polyester-based resin is obtained by polycondensing the sterol, the carboxylic acid component and the alcohol component, from the viewpoint of finely dispersing and stabilizing the polypropylene-based wax (W-1) in the resin binder composition to thereby improve fusing properties of the resulting toner to a PP film, the amount of the sterol used is preferably not less than 10 parts by mass, more preferably not less than 15 parts by mass, even more preferably not less than 20 parts by mass, further even more preferably not less than 25 parts by mass and still further even more preferably not less than 30 parts by mass, and is also preferably not more than 100 parts by mass, more preferably not more than 80 parts by mass and even more preferably not more than 50 parts by mass, on the basis of 100 parts by mass of a total amount of the alcohol component and the carboxylic acid component.

The mass ratio of the polypropylene-based wax (W-1) to the sterol used as the raw material of the polyester-based resin (W-1/sterol) is preferably not less than 0.1, more preferably not less than 0.3 and even more preferably not less than 0.5, and is also preferably not more than 1.2, more preferably not more than 1.0 and even more preferably not more than 0.8, from the viewpoint of improving fusing properties of the resulting toner to a PP film.

[Method for Producing Polyester-Based Resin]

[Reaction Conditions]

The alcohol component and the carboxylic acid component are subjected to polycondensation reaction to produce the polyester-based resin.

The polycondensation temperature is preferably not lower than 160° C., more preferably not lower than 190° C. and even more preferably not lower than 220° C., and is also preferably not higher than 260° C., more preferably not higher than 250° C. and even more preferably not higher than 240° C., from the viewpoint of improving the reactivity.

<<Esterification Catalyst>>

Examples of the esterification catalyst suitably used in the polycondensation reaction include titanium compounds and tin (II) compounds containing no Sn—C bond. These titanium compounds and tin compounds as the esterification catalyst may be used alone or in combination of any two or more thereof.

The titanium compound is preferably a titanium compound having a Ti—O bond and more preferably a titanium compound containing an alkoxy group having not less than 1 and not more than 28 carbon atoms in total, an alkenyloxy group or an acyloxy group.

As the tin (II) compound containing no Sn—C bond, preferred are tin (II) compounds having an Sn—O bond and tin (II) compounds having an Sn—X bond wherein X represents a halogen atom, etc., and more preferred are tin (II) compounds having an Sn—O bond. Among them, in particular, from the viewpoint of well controlling the reactivity and molecular weight as well as properties of the resulting composite resin, even more preferred is tin (II) di(2-ethyl hexanoate).

The amount of the esterification catalyst used is preferably not less than 0.01 part by mass, more preferably not less than 0.1 part by mass and even more preferably not less than 0.2 part by mass, and is also preferably not more than 1.5 parts by mass, more preferably not more than 1.0 part by mass and even more preferably not more than 0.6 part by mass, on the basis of 100 parts by mass of a total amount of the alcohol component and the carboxylic acid component, from the viewpoint of well controlling the reactivity and molecular weight as well as properties of the resulting composite resin.

<<Esterification Co-Catalyst>>

The esterification co-catalyst is preferably a pyrogallol compound. The pyrogallol compound is a compound containing a benzene ring in which three hydrogen atoms adjacent to each other are respectively substituted with a hydroxy group. Examples of the pyrogallol compound include pyrogallol, gallic acid, gallic acid esters, benzophenone derivatives such as 2,3,4-trihydroxybenzophenone and 2,2',3,4-tetrahydroxybenzophenone, and catechin derivatives such as epigallocatechin and epigallocatechin gallate. Among these pyrogallol compounds, gallic acid is preferably used from the viewpoint of improving the reactivity.

The amount of the esterification co-catalyst used is preferably not less than 0.001 part by mass, more preferably not less than 0.005 part by mass and even more preferably not less than 0.01 part by mass, and is also preferably not more than 0.15 part by mass, more preferably not more than 0.10 part by mass and even more preferably not more than 0.05 part by mass, on the basis of 100 parts by mass of a total amount of the alcohol component and the carboxylic acid component, from the viewpoint of well controlling the reactivity and molecular weight as well as properties of the resulting composite resin.

The mass ratio of the esterification co-catalyst to the esterification catalyst (esterification co-catalyst/esterification catalyst) is preferably not less than 0.001, more preferably not less than 0.01 and even more preferably not less than 0.02, and is also preferably not more than 0.5, more preferably not more than 0.3 and even more preferably not more than 0.1, from the viewpoint of improving the reactivity.

(Method for Producing Composite Resin (HB))

The composite resin (HB) is preferably produced by any of the following methods (1) to (3). Meanwhile, the bireactive monomer is preferably fed together with the raw material monomer of the vinyl-based resin segment (B) to the reaction system from the viewpoint of improving the reactivity. In addition, from the same viewpoint as described above, upon production of the composite resin, the catalysts such as the esterification catalyst and the esterification co-catalyst may also be used in the reaction, and further a polymerization initiator and a polymerization inhibitor may also be used in the reaction.

(1) Method of conducting the step (X) of subjecting the alcohol component and the carboxylic acid component to polycondensation reaction, followed by conducting the step (Y) of subjecting the raw material vinyl-based monomer of the vinyl-based resin segment (B) and, if required, the bireactive monomer to addition polymerization reaction.

Meanwhile, there is more preferably used such a method in which after subjecting a part of the carboxylic acid component to the polycondensation reaction in the step (X) and then conducting the step (Y), the reaction temperature is raised again, and a remaining part of the carboxylic acid component is added to the reaction system to allow the polycondensation reaction in the step (X) and, if required, the reaction with the bireactive monomer to further proceed.

(2) Method of conducting the step (Y) of subjecting the raw material monomer of the vinyl-based resin segment (B) and the bireactive monomer to addition polymerization reaction, followed by conducting the step (X) of subjecting the alcohol component and the carboxylic acid component to polycondensation reaction.

In this method, the alcohol component and the carboxylic acid component may be allowed to be previously present in the reaction system upon the addition polymerization reaction, followed by adding the esterification catalyst, if required, together with the esterification co-catalyst, to the reaction system at a temperature suitable for the polycondensation reaction to initiate the polycondensation reaction. Alternatively, the alcohol component and the polycarboxylic acid component may be subsequently added to the reaction system under the temperature conditions suitable for the polycondensation reaction to initiate the polycondensation reaction. In the former case, by adding the esterification catalyst, if required, together with the esterification co-catalyst, to the reaction system at a temperature suitable for the polycondensation reaction, it is possible to well control a molecular weight and a molecular weight distribution of the resulting polymer.

(3) Method of conducting the step (X) of subjecting the alcohol component and the carboxylic acid component to polycondensation reaction and the step (Y) of subjecting the raw material monomer of the vinyl-based resin segment (B) and the bireactive monomer to addition polymerization reaction in parallel with each other.

In this method, it is preferred that the step (X) and the step (Y) are conducted under the temperature conditions suitable for the addition polymerization reaction, and then the reaction temperature is raised until reaching the temperature conditions suitable for the polycondensation reaction, under which the polycondensation reaction as the step (X) is further conducted, if required, by adding a trivalent or higher-valent raw material monomers of the polyester-based resin segment (A), etc., as a crosslinking agent, to the reaction system. In such a case, under the temperature conditions suitable for the polycondensation reaction, it is possible to allow the polycondensation reaction only to proceed by adding a polymerization inhibitor to the reaction system. The bireactive monomer is concerned in not only the addition polymerization reaction but also the polycondensation reaction.

Of these methods, the method (1) is preferred because the degree of freedom for the polycondensation reaction temperature may be high. The aforementioned respective methods (1) to (3) are preferably conducted in the same reaction vessel.

[Addition Polymerization Reaction Temperature]

The temperature used for the addition polymerization reaction is preferably not lower than 110° C., more preferably not lower than 130° C. and even more preferably not lower than 150° C., and is also preferably not higher than 220° C., more preferably not higher than 190° C. and even more preferably not higher than 170° C., from the viewpoint of improving the reactivity. Also, the reaction system is preferably maintained under reduced pressure in a later stage of the addition polymerization reaction to promote the reaction.

<<Polymerization Inhibitor>>

The polymerization inhibitor may be a radical polymerization inhibitor. Specific examples of the radical polymerization inhibitor include 4-tert-butyl catechol, etc.

The polyester-based resin (b) containing the constitutional unit derived from the hydrocarbon wax (W-2) may be obtained by subjecting the hydrocarbon wax (W-2), the alcohol component and the carboxylic acid component to polycondensation reaction as described previously, whereas the polyester-based resin (c) containing the constitutional unit derived from a sterol may be obtained by subjecting the sterol, the alcohol component and the carboxylic acid component to polycondensation reaction as described previously. The hydrocarbon wax (W-2) and the sterol may be used in combination with each other.

<Optional Components>

The resin binder composition of the present invention may also contain conventionally known resins that may be used for the toner, for example, such as a polyester-based resin other than the polyester-based resin used in the present invention, a styrene-acrylic copolymer-based resin, an epoxy-based resin, a polycarbonate-based resin, a polyurethane-based resin, etc.

In addition, the resin binder composition of the present invention may also appropriately contain various additives such as a colorant, a charge controlling agent, a magnetic powder, a flow modifier, a conductivity modifier, an extender pigment, a reinforcing filler such as fibrous substances, an antioxidant, an anti-aging agent and a cleanability improver.

Meanwhile, in the present specification, the resin component including the polyester-based resin and the aforementioned conventionally known resins that may be optionally used for the toner may also be referred to as a "resin binder" in some cases. The content of the polyester-based resin in the resin binder is preferably not less than 80% by mass, more preferably not less than 90% by mass and even more preferably not less than 95% by mass, and is also not more than 100% by mass, and furthermore preferably 100% by mass, from the viewpoint of improving fusing properties of the resulting toner to a PP film.

(Colorant)

In the present invention, conventionally known colorants may be used as the colorant without any particular limitation, and the colorant may be appropriately selected according to the objects and applications thereof. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, calco oil blue, Methylene Blue Chloride, Phthalocyanine Blue, Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes, polymethine dyes, triphenylmethane dyes, diphenylmethane dyes, thiazine dyes and thiazole dyes. These colorants may be used alone or in combination of any two or more thereof.

The content of the colorant in the toner is preferably not less than 0.1 part by mass, more preferably not less than 0.5 part by mass and even more preferably not less than 1.0 part by mass, and is also preferably not more than 40 parts by mass, more preferably not more than 20 parts by mass and even more preferably not more than 10 parts by mass, on the basis of 100 parts by weight of the resin binder, from the viewpoint of improving an image density of the toner.

(Charge Controlling Agent)

Examples of the charge controlling agent include chromium-based azo dyes, iron-based azo dyes, aluminum-based azo dyes and metal complexes of salicylic acid. These charge controlling agents may be used alone or in combination of any two or more thereof.

The content of the charge controlling agent in the toner is preferably not less than 0.01 part by mass, more preferably not less than 0.1 part by mass and even more preferably not less than 0.2 part by mass, and is also preferably not more than 3.0 parts by mass, more preferably not more than 2.0 parts by mass and even more preferably not more than 1.5 parts by mass, on the basis of 100 parts by weight of the resin binder, from the viewpoint of improving charging stability of the toner.

<Process for Producing Resin Binder Composition>

The resin binder composition of the present invention may be produced, for example, by mixing the polyester-based resin and the polypropylene-based wax (W-1). In addition to the polyester-based resin and the polypropylene-based wax (W-1), a surfactant and the aforementioned other optional components may be further mixed in the resin binder composition of the present invention.

The mixture containing the polyester-based resin and the polypropylene-based wax (W-1) is preferably produced by the following production process 1A from the viewpoint of well controlling an endothermic amount ratio $\Delta H_{CW/W}$ of the resulting resin binder composition, enhancing a content of a small particle size component of the wax and obtaining a toner that is excellent in fusing properties to a PP film. However, in the case where the polyester-based resin is in the form of the composite resin (HB), the mixture is preferably produced by the following production process 1B. That is, the process for producing the resin binder composition according to the present invention is preferably either the following production process 1A or 1B.

(Production Process 1A)

The process 1A for production of the resin binder composition includes the following step 1A.

Step 1A: subjecting the carboxylic acid component and the alcohol component to polycondensation reaction in the presence of the polypropylene-based wax (W-1) to obtain the mixture containing the polyester-based resin and the polypropylene-based wax (W-1).

In the step 1A, the time of addition of the polypropylene-based wax (W-1) may be either before the polycondensation reaction or during the polycondensation reaction.

In the step 1A, it is preferable to add the hydrocarbon wax (W-2) to the polycondensation reaction system.

The preferred form of the hydrocarbon wax (W-2) is the same as described above. The mass ratio between the polypropylene-based wax (W-1) and the resin binder is also the same as described above.

The polypropylene-based wax (W-1) is preferably added to the reaction system either before the polycondensation reaction or during the polycondensation reaction.

More specifically, it is more preferred that the carboxylic acid component and the alcohol component as the raw material monomers of the polyester-based resin as well as the polypropylene-based wax (W-1) are mixed with each other, and then the resulting mixture is subjected to polycondensation reaction to produce the polyester-based resin.

(Production Process 1B)

The process 1B for production of the resin binder composition includes the following steps 1B-1 and 1B-2 in which the polypropylene-based wax (W-1) is added to the reaction system prior to the addition polymerization reaction of the step 1B-2.

Step 1B-1: subjecting the alcohol component and the carboxylic acid component to polycondensation reaction to produce the polyester-based resin segment (A).

Step 1B-2: subjecting the vinyl-based monomer, preferably the vinyl-based monomer containing an alkyl group having 6 to 22 carbon atoms, to addition polymerization reaction to produce the vinyl-based resin segment (B).

The expression "prior to the addition polymerization reaction" as used herein means any of "before the polycondensation reaction", "during the polycondensation reaction", "after the polycondensation reaction but before the addition polymerization reaction" and "during the addition polymerization reaction". In other words, the polypropylene-based wax (W-1) may be added to the reaction system either before the polycondensation reaction, during the polycondensation reaction, after the polycondensation reaction but before the addition polymerization reaction or during the addition polymerization reaction. Among them, the addition polymerization reaction is preferably conducted in the presence of the polypropylene-based wax (W-1). More specifically, it is more preferred that after the polyester-based resin segment (A) is produced by the polycondensation reaction, the polypropylene-based wax (W-1) is added, and then the raw material monomer of the vinyl-based resin segment (B) is added and subjected to the addition polymerization reaction to thereby produce the composite resin (HB).

It is considered that the aforementioned steps are capable of improving affinity between the polypropylene-based wax (W-1) and the composite resin (HB), and further not only enhancing ability of enclosing the polypropylene-based wax (W-1) in the resin, but also promoting non-crystallization of the polypropylene-based wax (W-1), so that it is possible to well control an endothermic amount ratio $\Delta H_{CW/W}$ of the resin binder composition and improve fusing properties of the resulting toner to a PP film.

The preferred form of the composite resin (HB) is the same as described above. The mass ratio between the polypropylene-based wax (W-1) and the composite resin (HB), i.e., the resin binder, is also the same as described above.

In addition, the term "reaction system" as used herein also means a reaction system including the polycondensation reaction system in the step 1B-1 or the addition polymerization reaction system in the step 1B-2. Meanwhile, the term "added" as used above also means such an embodiment in which the wax is previously added and mixed in the raw material monomers.

As the polymerization initiator used in the step 1B-2, from the viewpoint of well controlling an endothermic amount ratio $\Delta H_{CW/W}$ of the resulting resin binder composition, there may be mentioned, for example, alkyl peroxides such as dibutyl peroxide, dibutyl hexyl peroxide, p-menthane hydroperoxide and 1,1,3,3-tetramethyl butyl hydroperoxide. Of these polymerization initiators, from the viewpoint of reducing an endothermic amount ratio $\Delta H_{CW/W}$ of the resulting resin binder composition, preferred is dibutyl peroxide.

<Properties and Applications of Resin Binder Composition>

The softening point of the resin binder composition is preferably not lower than 85° C., more preferably not lower than 95° C. and even more preferably not lower than 105° C., and is also preferably not higher than 130° C., more preferably not higher than 120° C. and even more preferably not higher than 115° C., from the viewpoint of improving fusing properties of the resulting toner to a PP film.

The glass transition temperature of the resin binder composition is preferably not lower than 30° C., more preferably not lower than 40° C. and even more preferably not lower than 45° C., and is also preferably not higher than 90° C., more preferably not higher than 70° C. and even more preferably not higher than 55° C., from the viewpoint of improving fusing properties of the resulting toner to a PP film.

The acid value of the resin binder composition is preferably not less than 4 mgKOH/g, more preferably not less than 8 mgKOH/g and even more preferably not less than 12 mgKOH/g, and is also preferably not more than 30 mgKOH/g, more preferably not more than 25 mgKOH/g and even more preferably not more than 20 mgKOH/g, from the viewpoint of improving fusing properties of the resulting toner to a PP film.

The softening point, glass transition temperature and acid value of the resin binder composition may be suitably controlled by appropriately selecting kinds and proportions of the raw material monomers used as well as production conditions such as reaction temperature, reaction time and cooling rate or the like. In addition, the softening point, glass transition temperature and acid value of the resin binder composition may be respectively determined by the methods described in Examples below.

Meanwhile, as the configuration of the resin binder composition according to the present invention, there may be mentioned a melt-kneaded material of the resin binder composition, an organic solvent solution of the resin binder composition or the like. The methods for production of the respective configurations of the resin binder composition are described in the below-mentioned method for producing the toner.

The resin binder composition of the present invention is preferably used for printing images on a PP film as a printing medium by an electrophotographic method because of excellent fusing properties of the resulting toner to the PP film.

The resin binder composition of the present invention is also preferably used for production of a toner for development of electrostatic images which can be used for printing images on a polypropylene film. Furthermore, the resin binder composition of the present invention is more preferably used for printing images on a polypropylene film by an electrophotographic method.

[Toner and Method for Producing Toner]

The toner of the present invention includes the resin binder composition of the present invention.

The toner of the present invention may be in the form of either a pulverized toner or an emulsified and aggregated toner, and is preferably in the form of a pulverized toner.

Examples of the method for producing the toner includes the following methods.

(1) Method of melt-kneading a raw material mixture for a toner containing the resin binder composition and pulverizing the resulting melt-kneaded material to thereby produce the toner;

(2) Method of aggregating and coalescing resin binder particles constituted of the resin binder composition in a raw material mixture for a toner which contains a dispersion prepared by dispersing the resin binder composition in a water-soluble medium to obtain toner particles and thereby produce the toner;

(3) Method of stirring a dispersion prepared by dispersing the resin binder composition in a water-soluble medium and raw materials for a toner at a high speed to obtain toner particles and thereby produce the toner; and the like.

From the viewpoint of enhancing productivity of the toner as well as from the viewpoint of improving fusing properties of the resulting toner to a PP film, preferred is the method (1), i.e., the melt-kneading and pulverizing method. In addition, the toner may also be produced by the method (2), i.e., the aggregating and coalescing method.

Even when the toner is produced by any of the aforementioned methods, the amount of the resin binder composition used is preferably not less than 5% by mass, more preferably not less than 30% by mass, even more preferably not less than 50% by mass, further even more preferably not less than 70% by mass, still further even more preferably not less than 80% by mass and still further even more preferably not less than 90% by mass, and is also preferably not more than 100% by mass and more preferably not more than 99% by mass, from the viewpoint of improving fusing properties of the resulting toner to a PP film and enhancing transparency of the resulting printed material.

(1) Method of Melt-Kneading the Resin Binder Composition and Pulverizing the Resulting Melt-Kneaded Material to Thereby Produce the Toner (Melt-Kneading and Pulverizing Method):

The method (1) preferably includes the following steps 2A-1 and 2A-2.

Step 2A-1: melt-kneading a raw material mixture for a toner containing the resin binder composition of the present invention.

Step 2A-2: pulverizing the melt-kneaded material obtained in the step 2A-1 and classifying the resulting pulverized product.

<Step 2A-1>

In addition, in the step 2A-1, the raw material mixture is preferably further melt-kneaded together with additives such as a colorant, a releasing agent other than the polypropylene-based wax (W-1) and a charge controlling agent.

The melt-kneading of the raw material mixture, etc., may be conducted using a conventionally known kneader such as a closed-type kneader, a single- or twin-screw extruder, an open roll kneader, etc. Of these kneaders, from the viewpoint of highly dispersing the additives such as a colorant, a charge controlling agent and a releasing agent in the toner with good efficiency even without repeating the kneading operation or using any dispersant, the open roll kneader is preferably used. The open roll kneader is preferably provided with a feed port and a discharge port for the obtained kneaded material along an axial direction of the roll.

It is preferred that the resin binder composition of the present invention as well as the additives such as a colorant, a charge controlling agent and a releasing agent are preferably previously mixed with each other using a mixer such as a Henschel mixer and a ball mill, and then the resulting mixture is fed to the kneader.

The open roll kneader is in the form of a kneader whose kneading section is not closed but opened such that heat of kneading generated upon the kneading can be readily released therefrom. In addition, the open roll kneader of a continuous type is preferably in the form of a kneader equipped with at least two rolls. The open roll kneader of a continuous type which may be used in the present invention is a kneader equipped with two rolls that are different in peripheral speed from each other, i.e., a kneader equipped with a high speed rotating-side roll having a high peripheral speed and a low speed rotating-side roll having a low peripheral speed. In the present invention, from the viewpoint of improving dispersibility of the additives such as a colorant, a charge controlling agent and a releasing agent in the toner, from the viewpoint of reducing a mechanical force required upon the melt-kneading and suppressing generation of heat thereupon as well as from the viewpoint of reducing the temperature used upon the melt-kneading, it is preferred that the high speed rotating-side roll is a heating roll, and the low speed rotating-side roll is a cooling roll.

The temperature of the rolls may be controlled by adjusting a temperature of a heating medium that is allowed to pass through an inside of the rolls.

The heating temperature of the inside of the rolls is preferably not lower than 20° C. and more preferably not lower than 30° C., and is also preferably not higher than 150° C. and more preferably not higher than 100° C., from the viewpoint of improving fusing properties of the resulting toner to a PP film.

The rotating speed of the respective rolls is preferably not less than 50 r/min, more preferably not less than 100 r/min and even more preferably not less than 150 r/min, and is also preferably not more than 350 r/min, more preferably not more than 300 r/min and even more preferably not more than 250 r/min, from the viewpoint of improving dispersibility of the additives such as a colorant, a charge controlling agent and a releasing agent in the toner as well as from the viewpoint of reducing a mechanical force required upon the melt-kneading and suppressing generation of heat thereupon.

The peripheral speed of the respective rolls is preferably not less than 0.07 m/min, more preferably not less than 0.15 m/min and even more preferably not less than 0.20 m/min, and is also preferably not more than 0.50 m/min, more preferably not more than 0.45 m/min and even more preferably not more than 0.40 m/min, from the viewpoint of improving dispersibility of the additives such as a colorant, a charge controlling agent and a releasing agent in the toner as well as from the viewpoint of reducing a mechanical force required upon the melt-kneading and suppressing generation of heat thereupon.

The structure, size, material, etc., of the rolls are not particularly limited, and the surface of the rolls may also have any shape such as a smooth shape, a wavy shape, an irregular shape, etc. However, from the viewpoint of enhancing a shear force upon the kneading and improving dispersibility of the additives such as a colorant, a charge controlling agent and a releasing agent in the toner as well as from the viewpoint of reducing a mechanical force required upon the melt-kneading and suppressing generation of heat thereupon, a plurality of spiral grooves are preferably engraved on the surface of the respective rolls.

The melt-kneaded material obtained in the step 2A-1 is cooled to such an extent that it can be pulverized, and then subjected to the subsequent step 2A-2.

<Step 2A-2>

In the step 2A-2, the melt-kneaded material obtained in the step 2A-1 is pulverized, and then the resulting pulverized product is classified.

The pulverization step may be conducted in multiple stages. For example, a resin kneaded material obtained by curing the melt-kneaded material may be coarsely pulverized into a size of about 1 to about 5 mm, and then the thus obtained coarsely pulverized product may be further finely pulverized into a desired particle size.

The pulverizer used in the pulverization step is not particularly limited. Examples of the pulverizer suitably used for the coarse pulverization include a hammer mill, an atomizer, a Rotoplex, etc. In addition, examples of the pulverizer suitably used for the fine pulverization include a fluidized bed jet mill, an impingement plate-type jet mill, a rotating mechanical mill, etc. Of these pulverizers, from the viewpoint of improving pulverization efficiency, preferred is a fluidized bed jet mill or an impingement plate-type jet mill, and more preferred is a fluidized bed jet mill.

Examples of the classifier used for the classification step include a rotor-type classifier, an airflow-type classifier, an inertia classifier, a sieve-type classifier, etc. If the degree of pulverization of the material to be subjected to the classification step is still insufficient, the material may be subjected again to the pulverization step, and if required, the pulverization step and the classification step may be repeated as desired.

(2) Method of Aggregating and Coalescing Resin Binder Particles in a Dispersion Prepared by Dispersing the Resin Binder Composition in a Water-Soluble Medium (Aggregating and Coalescing Method):

The method (2) preferably includes the following steps 2B-1, 2B-2 and 2B-3.

Step 2B-1: obtaining an aqueous dispersion of the resin binder particles containing the resin binder composition of the present invention.

Step 2B-2: aggregating the resin binder particles obtained in the step 2B-1 and, if required, the raw materials for a toner to obtain aggregated p articles.

Step 2B-3: coalescing the aggregated particles obtained in the step 2B-2.

<Step 2B-1>

The aqueous dispersion of the resin binder particles containing the resin binder composition used in the present invention (hereinafter also referred to merely as an "aqueous dispersion") is preferably produced by the following step 2B-1a.

Step 2B-1a: adding an aqueous medium to an organic solvent solution containing the resin binder composition of the present invention to subject the solution to phase inversion emulsification, thereby obtaining the aqueous dispersion of the resin binder particles containing the resin binder composition.

In the present specification, the aqueous dispersion as used herein may be any aqueous dispersion as long as the resin binder particles are present in a dispersed state in a solvent containing the aqueous medium. The aqueous dispersion is preferably maintained as such at 25° C. for 24 hours without being separated into layers.

Meanwhile, in the present specification, the particles containing the resin binder composition that is included in the aforementioned aqueous dispersion may also be referred to as "resin binder particles" in some cases.

The aqueous dispersion may also contain an organic solvent in addition to the aqueous medium. The content of the aqueous medium in a whole amount of the aqueous medium and the organic solvent is preferably not less than 50% by mass, more preferably not less than 70% by mass, even more preferably not less than 80% by mass and further even more preferably not less than 85% by mass. In the following, the phase inversion emulsification method is described.

The phase inversion emulsification may be conducted by adding the aqueous medium to the organic solvent solution of the resin binder composition of the present invention. When adding the aqueous medium to the organic solvent solution, a W/O phase is first formed, and then the thus formed W/O phase is subjected to phase inversion into an O/W phase. Whether the phase inversion takes place or not may be confirmed, for example, by observation by naked eyes, measurement of electrical conductivity, etc.

In the phase inversion step, as described hereinlater, the particle size of the resin binder particles, etc., may be controlled by adjusting the velocity and amount of the aqueous medium added.

The organic solvent solution containing the resin binder composition may be produced by the method of dissolving or dispersing the resin binder composition in an organic solvent, if required, after mixing or kneading the resin binder composition.

[Organic Solvent]

The organic solvent used in the aforementioned method preferably has a solubility parameter (SP value: refer to "Polymer Handbook, Third Edition", published in 1989 by John Wiley & Sons, Inc.) of not less than 15.0 $MPa^{1/2}$, more preferably not less than 16.0 $MPa^{1/2}$ and even more preferably not less than 17.0 $MPa^{1/2}$, and also preferably not more than 26.0 $MPa^{1/2}$, more preferably not more than 24.0 $MPa^{1/2}$ and even more preferably not more than 22.0 $MPa^{1/2}$, from the viewpoint of improving solubility of the polyester-based resin therein.

Specific examples of the organic solvent include the following organic solvents. Meanwhile, the numeral values appearing in parentheses on the right side of the name of the respective organic solvents indicate SP values (unit: $MPa^{1/2}$) thereof. More specifically, specific examples of the organic solvents include alcohol solvents such as ethanol (26.0), isopropanol (23.5) and isobutanol (21.5); ketone solvents such as acetone (20.3), methyl ethyl ketone (19.0), methyl isobutyl ketone (17.2) and diethyl ketone (18.0); ether solvents such as dibutyl ether (16.5), tetrahydrofuran (18.6) and dioxane (20.5); and acetic acid ester solvents such as ethyl acetate (18.6) and isopropyl acetate (17.4). Of these organic solvents, from the viewpoint of improving fusing properties of the resulting toner to a PP film, preferred are ketone solvents and acetic acid ester solvents, more preferred is at least one solvent selected from the group consisting of methyl ethyl ketone, ethyl acetate and isopropyl acetate. Among them, even more preferred are ketone solvents, and further even more preferred is methyl ethyl ketone.

The mass ratio of the organic solvent to the resin binder composition (organic solvent/resin binder composition) is preferably not less than 0.1, more preferably not less than 0.2 and even more preferably not less than 0.25, and is also preferably not more than 1, more preferably not more than 0.5 and even more preferably not more than 0.35.

In addition, in the aforementioned step 2B-1a, from the viewpoint of improving dispersion stability of the resin binder composition, it is preferable to add a neutralizing agent to the resin binder composition.

[Neutralizing Agent]

Examples of the neutralizing agent include hydroxides of alkali metals such as lithium hydroxide, sodium hydroxide and potassium hydroxide; and organic base compounds such as ammonia, trimethylamine, ethylamine, diethylamine, triethylamine, triethanolamine and tributylamine. Of these neutralizing agents, from the viewpoint of improving fusing properties of the resulting toner to a PP film, preferred is sodium hydroxide.

The temperature used upon the neutralization is preferably not lower than 30° C., more preferably not lower than 50° C. and even more preferably not lower than 60° C., and is also preferably not higher than 90° C., more preferably not higher than 85° C. and even more preferably not higher than 80° C.

The equivalent (mol %) of the neutralizing agent used on the basis of an acid group of the polyester-based resin is preferably not less than 10 mol %, more preferably not less than 20 mol % and even more preferably not less than 30 mol %, and is also preferably not more than 150 mol %, more preferably not more than 100 mol % and even more preferably not more than 60 mol %.

Meanwhile, the equivalent (mol %) of the neutralizing agent used for neutralizing the polyester-based resin may be determined according to the following formula. In the case where the equivalent of the neutralizing agent used is not more than 100 mol %, the equivalent of the neutralizing agent used has the same meaning as that of a degree of neutralization of the resin with the neutralizing agent. In the case where the equivalent of the neutralizing agent used which is determined according to the following formula exceeds 100 mol %, it means such a condition that the neutralizing agent is present in an excessive amount relative to the acid group of the resin. In such a case, the degree of neutralization of the resin is regarded as being 100 mol %.

Equivalent of neutralizing agent used={[mass (g) of neutralizing agent added/equivalent of neutralizing agent]/[[acid value of polyester-based resin (mgKOH/g)×mass (g) of resin]/(56×1000)]}×100.

[Aqueous Medium]

The aqueous medium preferably contains water as a main component.

Examples of components other than water which may be contained in the aqueous medium include water-soluble organic solvents, e.g., aliphatic alcohols having not less than 1 and not more than 5 carbon atoms, such as methanol, ethanol, isopropanol and butanol; dialkyl ketones containing an alkyl group having not less than 1 and not more than 3 carbon atoms, such as acetone and methyl ethyl ketone; and cyclic ethers such as tetrahydrofuran. Of these organic solvents, from the viewpoint of preventing inclusion of the organic solvents into the resulting toner, alcohol-based organic solvents that are incapable of dissolving the polyester-based resin therein, such as methanol, ethanol, isopropanol and butanol, may be suitably used.

From the viewpoint of improving dispersion stability of the resin binder particles, the content of water in the aqueous medium is preferably not less than 80% by mass, more preferably not less than 90% by mass and even more preferably not less than 95% by mass, and is also not more than 100% by mass, and furthermore preferably 100% by mass. As the water, deionized water or distilled water is preferably used.

The temperature used upon addition of the aqueous medium is preferably not lower than 15° C., more preferably not lower than 20° C. and even more preferably not lower than 25° C., and is also preferably not higher than 80° C., more preferably not higher than 60° C. and even more preferably not higher than 40° C., from the viewpoint of improving dispersion stability of the resin binder particles.

From the viewpoint of improving dispersion stability of the resin binder particles, the velocity of addition of the aqueous medium before the phase inversion emulsification is preferably not less than 0.1 part by mass/minute, more preferably not less than 1 part by mass/minute and even more preferably not less than 3 parts by mass/minute, and is also preferably not more than 50 parts by mass/minute, more preferably not more than 20 parts by mass/minute and even more preferably not more than 10 parts by mass/minute, on the basis of 100 parts by mass of the resin binder composition. Meanwhile, the velocity of addition of the aqueous medium after the phase inversion emulsification is not particularly limited.

From the viewpoint of improving dispersion stability of the resin binder particles as well as from the viewpoint of obtaining uniform aggregated particles in the subsequent aggregation step, the amount of the aqueous medium added is preferably not less than 100 parts by mass, more preferably not less than 200 parts by mass and even more preferably not less than 400 parts by mass, and is also preferably not more than 900 parts by mass, more preferably not more than 700 parts by mass and even more preferably not more than 500 parts by mass, on the basis of 100 parts by mass of the resin binder composition.

[Surfactant]

Examples of the surfactant include a nonionic surfactant, an anionic surfactant and a cationic surfactant. Of these surfactants, from the viewpoint of improving dispersion stability of the resin binder particles, preferred is at least one surfactant selected from the group consisting of a nonionic surfactant and an anionic surfactant, and more preferred is an anionic surfactant.

Specific examples of the nonionic surfactant include polyoxyethylene alkyl aryl ethers or polyoxyethylene alkyl ethers such as polyoxyethylene nonyl phenyl ether, polyoxyethylene oleyl ether and polyoxyethylene lauryl ether; polyoxyethylene fatty acid esters such as polyethylene glycol monolaurate, polyethylene glycol monostearate and polyethylene glycol monooleate; and oxyethylene/oxypropylene block copolymers. Of these nonionic surfactants, from the viewpoint of improving dispersion stability of the resin binder particles, preferred are polyoxyethylene alkyl ethers.

Specific examples of the anionic surfactant include alkyl benzenesulfonic acid salts such as sodium alkylbenzenesulfonates; alkyl sulfuric acid salts such as sodium alkylsulfates; and alkylethersulfuric acid salts such as sodium alkylethersulfates. Of these anionic surfactants, from the viewpoint of improving dispersion stability of the resin binder particles, preferred are sodium alkylbenzenesulfonates and alkylethersulfuric acid salts, more preferred are alkylethersulfuric acid salts, even more preferred are sodium alkylethersulfates, and further even more preferred is sodium polyoxyethylene laurylethersulfate.

Specific examples of the cationic surfactant include alkyltrimethyl ammonium chlorides, dialkyldimethyl ammonium chlorides and the like.

[Removal of Organic Solvent]

After completion of the phase inversion emulsification, if required, there may be conducted the step of removing the organic solvent from the dispersion obtained in the phase inversion emulsification.

The method of removing the organic solvent from the dispersion is not particularly limited, and the organic solvent is preferably removed from the dispersion by distillation. In the distillation step, the dispersion is preferably heated to a temperature not lower than a boiling point of the organic solvent. In addition, from the viewpoint of improving dispersion stability of the resin binder particles, the distillation is more preferably distillation under reduced pressure. Meanwhile, the residual organic solvent may be present in the resulting aqueous dispersion. The content of the residual organic solvent in the aqueous dispersion is preferably not more than 1% by mass, more preferably not more than 0.5% by mass and even more preferably substantially 0% by mass.

[Addition of Surfactant]

Also, after completion of the phase inversion emulsification, there may be conducted the step of mixing the aforementioned surfactant in the aqueous dispersion.

The amount of the surfactant added in the present step is preferably not less than 50% by mass, more preferably not less than 70% by mass and even more preferably not less than 90% by mass, and is also not more than 100% by mass, and furthermore preferably 100% by mass, on the basis of a whole amount of the surfactants added through the method for production of the toner, from the viewpoint of improving dispersion stability of the resin binder particles.

In addition, the amount of the surfactant added in the present step is preferably not less than 0.5 part by mass, more preferably not less than 1 part by mass and even more preferably not less than 2 parts by mass, and is also preferably not more than 20 parts by mass, more preferably not more than 15 parts by mass and even more preferably not more than 13 parts by mass, on the basis of 100 parts by mass of the resin binder composition, from the viewpoint of improving dispersion stability of the resin binder particles.

Upon adding the surfactant, the dispersion is preferably stirred by an ordinary mixing and stirring apparatus such as a mixing stirrer equipped with an agitation blade, an external circulation stirring apparatus, etc.

When using the mixing stirrer equipped with an agitation blade, the peripheral speed of the agitation blade upon stirring is preferably not less than 20 m/min, more preferably not less than 40 m/min, even more preferably not less than 60 m/min and further even more preferably not less than 80 m/min, and is also preferably not more than 200 m/min, more preferably not more than 150 m/min and even more preferably not more than 100 m/min, from the viewpoint of improving the dispersibility of the surfactant in the dispersion.

The temperature used upon adding the surfactant is preferably not lower than 5° C., more preferably not lower than 10° C. and even more preferably not lower than 20° C., and is also preferably not higher than 50° C., more preferably not higher than 40° C. and even more preferably not higher than 35° C., from the viewpoint of improving the dispersibility of the surfactant in water.

[Volume Median Particle Size ($D_{50}$) of Resin Binder Particles]

The volume median particle size ($D_{50}$) of the resin binder particles in the aqueous dispersion is preferably not less than 100 nm, more preferably not less than 150 nm and even more preferably not less than 200 nm, and is also preferably not more than 800 nm, more preferably not more than 600 nm and even more preferably not more than 300 nm, from the viewpoint of improving fusing properties of the resulting toner to a PP film.

Meanwhile, the volume median particle size ($D_{50}$) as used herein means a particle size at which a cumulative volume frequency calculated on the basis of a volume fraction of the particles from a smaller particle size side thereof is 50%, and may be determined by the method described in Examples below.

<Step 2B-2>

The step 2B-2 is the step of aggregating the resin binder particles obtained in the step 2B-1 to obtain aggregated particles.

In this step, an aggregating agent is preferably added to efficiently conduct aggregation of the resin binder particles. In addition, in the step 2B-2, various additives such as a colorant, a charge controlling agent, a releasing agent, a conductivity modifier, a reinforcing filler such as fibrous substances, an antioxidant and an anti-aging agent may be added.

[Aggregating Agent]

Specific examples of the aggregating agent used in the present invention include organic aggregating agents such as a cationic surfactant in the form of a quaternary salt and polyethyleneimine; and inorganic aggregating agents such as inorganic metal salts and inorganic ammonium salts. Of these aggregating agents, from the viewpoint of improving fusing properties of the resulting toner to a PP film, preferred are inorganic aggregating agents, and more preferred are inorganic metal salts.

Specific examples of the inorganic metal salts include sodium sulfate, sodium chloride, calcium chloride, calcium nitrate, barium chloride, magnesium chloride, zinc chloride and aluminum chloride. Of these inorganic metal salts, preferred is calcium chloride. The valence of the central metal of the inorganic metal salts is preferably divalence or higher valence from the viewpoint of improving fusing properties of the resulting toner to a PP film.

The amount of the aggregating agent used is preferably not less than 0.10 part by mass, more preferably not less than 0.15 part by mass and even more preferably not less than 0.20 part by mass, and also is preferably not more than 5 parts by mass, more preferably not more than 1 part by mass and even more preferably not more than 0.5 part by mass, on the basis of 100 parts by weight of the resin binder particles, from the viewpoint of well controlling aggregation of the resin binder particles to obtain aggregated particles having a desired particle size. The aggregating agent is preferably added in the form of an aqueous solution prepared by dissolving the aggregating agent in an aqueous medium.

The solid content of the dispersion in the reaction system in the step 2B-2 is preferably not less than 5% by mass, more preferably not less than 10% by mass and even more preferably not less than 15% by mass, and is also preferably not more than 50% by mass, more preferably not more than 40% by mass and even more preferably not more than 30% by mass, from the viewpoint of allowing uniform aggregation of the resin binder particles.

The temperature used upon addition of the aggregating agent is preferably not lower than 0° C., more preferably not lower than 10° C. and even more preferably not lower than 20° C., and is also preferably not higher than 60° C., more preferably not higher than 55° C. and even more preferably not higher than 50° C., from the viewpoint of enhancing productivity of the toner.

[Colorant]

As the colorant used in the step 2B-2, there may be mentioned the same colorants as those that may be incorporated in the resin binder composition of the present invention, and the preferred forms of the colorant used in the step 2B-2 are also the same as those used in the resin binder composition of the present invention.

The colorant may be added in the form of a colorant dispersion containing the colorant particles.

The volume median particle size ($D_{50}$) of the colorant particles is preferably not less than 50 nm, more preferably not less than 80 nm and even more preferably not less than 100 nm, and is also preferably not more than 500 nm, more preferably not more than 300 nm and even more preferably not more than 150 nm, from the viewpoint of obtaining a toner capable of forming high-quality images.

[Charge Controlling Agent]

As the charge controlling agent used in the step 2B-2, there may be mentioned the same charge controlling agents as those that may be incorporated in the resin binder composition of the present invention, and the preferred forms of the charge controlling agent used in the step 2B-2 are also the same as those used in the resin binder composition of the present invention.

The charge controlling agent may be added in the form of a charge controlling agent dispersion containing the charge controlling agent particles. The volume median particle size ($D_{50}$) of the charge controlling agent particles is preferably not less than 100 nm, more preferably not less than 200 nm and even more preferably not less than 300 nm, and is also preferably not more than 800 nm, more preferably not more than 600 nm and even more preferably not more than 500 nm.

The volume median particle size ($D_{50}$) of the resulting aggregated particles is preferably not less than 2 μm, more preferably not less than 3 μm and even more preferably not less than 4 μm, and is also preferably not more than 10 μm, more preferably not more than 8 μm and even more preferably not more than 6 μm, from the viewpoint of improving fusing properties of the resulting toner to a PP film.

<Step 2B-3>

The step 2B-3 is the step of coalescing the aggregated particles obtained in the step 2B-2. In this step, the respective particles that are present in the aggregated particles under such a condition that they are allowed to adhere to each other mainly by a physical force solely are coalesced and integrated together to form coalesced particles.

In the step 2B-3, the reaction system is preferably maintained at a temperature not lower than a glass transition temperature of the polyester-based resin from the viewpoint of improving coalescing properties of the aggregated particles as well as from the viewpoint of improving fusing properties of the resulting toner to a PP film.

From the viewpoint of improving coalescing properties of the aggregated particles as well as from the viewpoint of enhancing productivity of the toner, the temperature to be maintained in the step 2B-3 is preferably not lower than a temperature higher by 10° C. than the glass transition temperature of the polyester-based resin, more preferably not lower than a temperature higher by 15° C. than the glass transition temperature and even more preferably not lower than a temperature higher by 20° C. than the glass transition temperature, and is also preferably not higher than a temperature higher by 50° C. than the glass transition temperature of the polyester-based resin, more preferably not higher than a temperature higher by 40° C. than the glass transition temperature and even more preferably not higher than a temperature higher by 30° C. than the glass transition temperature.

More concretely, the temperature to be maintained in the step 2B-3 is preferably not lower than 70° C. and more preferably not lower than 75° C., and is also preferably not higher than 100° C. and preferably not higher than 90° C. The stirring velocity of the aggregated particles is preferably controlled so as not to cause precipitation of the aggregated particles.

Meanwhile, when using an aggregation stopping agent, a surfactant is preferably used as the aggregation stopping agent. The aggregation stopping agent is more preferably an anionic surfactant. As the anionic surfactant, preferred is at least one compound selected from the group consisting of alkylethersulfuric acid salts, alkylsulfuric acid salts and linear alkylbenzenesulfonic acid salts. Of these anionic surfactants, more preferred are alkylethersulfuric acid salts.

<<Additional Treatment Step>>

The coalesced particles obtained in the aforementioned step are then appropriately subjected to a solid-liquid separation step such as filtration, a washing step and a drying step to thereby suitably obtain the toner of the present invention.

In the washing step, the surfactants added in any previous steps are preferably completely removed by washing. Therefore, the resulting particles are preferably washed with an aqueous solution at a temperature not higher than a cloud point of the nonionic surfactant. The washing treatment is preferably carried out plural times.

In addition, in the drying step, there may be used a vibration-type fluidization drying method, a spray-drying method, a freeze-drying method and a flash jet method, etc. The content of water in the toner obtained after drying is preferably adjusted to not more than 1.5% by mass and more preferably not more than 1.0% by mass from the viewpoint of improving charging properties of the resulting toner.

Furthermore, in order to improve flowability of the toner, etc., an external additive may be added thereto. Examples of the external additive usable in the present invention include inorganic fine particles such as silica fine particles whose surface is subjected to hydrophobic treatment, titanium oxide fine particles, alumina fine particles, cerium oxide fine particles and carbon blacks; and polymer fine particles such as fine particles of polycarbonates, polymethyl methacrylate, silicone resins, etc.

The number-average particle size of the external additive is preferably not less than 4 nm, more preferably not less than 8 nm and even more preferably not less than 12 nm, and is also preferably not more than 200 nm, more preferably not more than 50 nm and even more preferably not more than 30 nm, from the viewpoint of improving flowability of the toner.

The amount of the external additive added is preferably not less than 0.1 part by mass, more preferably not less than 0.5 part by mass and even more preferably not less than 1 part by mass, and is also preferably not more than 5 parts by mass, more preferably not more than 4 parts by mass and even more preferably not more than 3 parts by mass, on the basis of 100 parts by mass of the toner particles before being treated with the external additive, from the viewpoint of improving flowability of the toner as well as environmental stability of the degree of chargeability of the toner.

The volume median particle size ($D_{50}$) of the toner of the present invention is preferably not less than 2 μm, more preferably not less than 3 μm and even more preferably not less than 4 μm, and is also preferably not more than 20 μm, more preferably not more than 15 μm and even more preferably not more than 10 μm, from the viewpoint of improving fusing properties of the resulting toner to a PP film.

The toner of the present invention contains the resin binder composition according to the present invention and is therefore excellent in fusing properties to a PP film. More specifically, the printing method of the present invention includes the step of printing images on a polypropylene film using the toner for development of electrostatic images according to the present invention by an electrophotographic method.

With respect to the aforementioned embodiments, in the present specification, there are further provided the following aspects relating to the resin binder composition.

<1> A resin binder composition for toners for development of electrostatic images including a polyester-based resin and a polypropylene-based wax (W-1), in which the resin binder composition has an endothermic amount ratio $\Delta H_{CW/W}$ of not less than 0.10 and not more than 0.80, the endothermic amount ratio $\Delta H_{CW/W}$ being represented by the following formula (1):

$$\text{Endothermic Amount Ratio } \Delta H_{CW/W} = \Delta H_{CW}/\Delta H_W \quad (1)$$

wherein $\Delta H_{CW}$ is an endothermic amount of a melting endothermic peak per 1 g of the polypropylene-based wax (W-1) as measured with respect to the resin binder composition; and $\Delta H_W$ is an endothermic amount of a melting endothermic peak per 1 g of the polypropylene-based wax (W-1) as measured with respect to the polypropylene-based wax (W-1) singly, $\Delta H_{CW}$ and $\Delta H_W$ each representing an endothermic amount as measured at a temperature rise rate of 10° C./min using a differential scanning calorimeter.

<2> A resin binder composition for toners for development of electrostatic images including a polyester-based resin and a polypropylene-based wax (W-1), in which the polypropylene-based wax (W-1) is dispersed in the polyester-based resin;

a volume-median particle size ($D_{50}$) of the wax as a whole as measured by a dynamic light scattering method using a dispersion H prepared by the following Method 1 is not less than 1 μm and not more than 50 μm;

a volume-median particle size ($D_{50}$) of a small particle size component of the wax as measured by a dynamic light scattering method using a dispersion S of the small particle size component of the wax which is prepared by the following Method 2 is not less than 20 nm and not more than 400 nm; and a content of the small particle size component of the wax is not less than 20% by mass and not more than 90% by mass on the basis of a total amount of the wax in the dispersion H, Method 1: 1 part by mass of the resin binder composition and 30 parts by mass of methyl ethyl ketone are stirred for 1 hour to prepare the dispersion H; and Method 2: after stirring the dispersion prepared by the aforementioned Method 1, the dispersion is allowed to stand for 24 hours to precipitate a large particle size component of the wax and separate a supernatant solution therefrom, thereby obtaining the dispersion S of the small particle size component of the wax.

<3> A resin binder composition for toners for development of electrostatic images including a polyester-based resin and a polypropylene-based wax (W-1), in which the polypropylene-based wax (W-1) is dispersed in the polyester-based resin;

the resin binder composition has an endothermic amount ratio $\Delta H_{CW/W}$ of not less than 0.10 and not more than 0.80, the endothermic amount ratio $\Delta H_{CW/W}$ being represented by the following formula (1):

$$\text{Endothermic Amount Ratio } \Delta H_{CW/W} = \Delta H_{CW}/\Delta H_W \quad (1)$$

wherein $\Delta H_{CW}$ is an endothermic amount of a melting endothermic peak per 1 g of the polypropylene-based wax (W-1) as measured with respect to the resin binder composition; and $\Delta H_W$ is an endothermic amount of a melting endothermic peak per 1 g of the polypropylene-based wax (W-1) as measured with respect to the polypropylene-based wax (W-1) singly, $\Delta H_{CW}$ and $\Delta H_W$ each representing an endothermic amount as measured at a temperature rise rate of 10° C./min using a differential scanning calorimeter;

a volume-median particle size ($D_{50}$) of the wax as a whole as measured by a dynamic light scattering method using a dispersion H prepared by the following Method 1 is not less than 1 μm and not more than 50 μm;

a volume-median particle size ($D_{50}$) of a small particle size component of the wax as measured by a dynamic light scattering method using a dispersion S of the small particle size component which is prepared by the following Method 2 is not less than 20 nm and not more than 400 nm; and a content of the small particle size component of the wax in the resin binder composition is not less than 20% by mass and not more than 90% by mass on the basis of a total amount of the wax in the dispersion H, Method 1: 1 part by mass of the resin binder composition and 30 parts by mass of methyl ethyl ketone are stirred for 1 hour to prepare the dispersion H; and Method 2: after stirring the dispersion prepared by the aforementioned Method 1, the dispersion is allowed to stand for 24 hours to precipitate a large particle size component of the wax and separate a supernatant solution therefrom, thereby obtaining the dispersion S of the small particle size component of the wax.

<4> A toner for development of electrostatic images including the resin binder composition according to any one of the aspects <1> to <3>.

<5> A toner for development of electrostatic images used for a polypropylene film including the resin binder composition according to any one of the aspects <1> to <3>.

<6> A printing method including the step of printing images on a polypropylene film by an electrophotographic method using the toner for development of electrostatic images according to the aspect <4>.

<7> A use of the resin binder composition according to any one of the aspects <1> to <3> for printing images on a polypropylene film by an electrophotographic method.

<8> A use of the resin binder composition according to any one of the aspects <1> to <3> for producing a toner for development of electrostatic images which is used for printing images on a polypropylene film.

EXAMPLES

Respective properties, etc., were measured and evaluated by the following methods.

[Melting Point (Mp) of Wax]

Using a differential scanning calorimeter "DSC210" available from Seiko Instruments Inc., a sample was heated to 200° C., and then cooled from 200° C. to 0° C. at a temperature drop rate of 10° C./minute, and further heated at a temperature rise rate of 10° C./minute to measure a heat of fusion thereof. The maximum peak temperature of the heat of fusion was defined as a melting point of the sample.

[Acid Value and Hydroxy Value of Wax]

Measured according to JIS K 0070. However, with respect to only a solvent used for the measurement, the mixed solvent of ethanol and ether as prescribed in JIS K 0070 was replaced with chloroform.

[Acid Values of Resin Binder and Mixture Containing Resin Binder and Wax]

Measured according to JIS K 0070. However, with respect to only a solvent used for the measurement, the mixed solvent of ethanol and ether as prescribed in JIS K 0070 was replaced with a mixed solvent containing acetone and toluene at a volume ratio (acetone:toluene) of 1:1.

[Softening Points and Glass Transition Temperatures of Resin Binder and Mixture Containing Resin Binder and Wax]

(1) Softening Point

Using a flow tester "CFT-500D" available from Shimadzu Corporation, 1 g of a sample was extruded through a nozzle having a die pore diameter of 1 mm and a length of 1 mm while heating the sample at a temperature rise rate of 6° C./minute and applying a load of 1.96 MPa thereto by a plunger. The softening point was determined as the temperature at which a half amount of the sample was flowed out when plotting a downward movement of the plunger of the flow tester relative to the temperature.

(2) Endothermic Maximum Peak Temperature

Using a differential scanning calorimeter "Q100" available from TA Instruments Japan Inc., a sample was cooled from room temperature (20° C.) to 0° C. at a temperature drop rate of 10° C./minute and then allowed to stand as such under the conditions for 1 minute, and then heated to 180° C. at a temperature rise rate of 10° C./minute to measure an endothermic heat amount thereof. Among the endothermic peaks observed in the thus measured characteristic curve, the temperature of the peak located on the highest temperature side was defined as the endothermic maximum peak temperature.

(3) Glass Transition Temperature

Using a differential scanning calorimeter "Q100" available from TA Instruments Japan Inc., a sample was weighed in an amount of 0.01 to 0.02 g in an aluminum pan, heated to 200° C. and then cooled from 200° C. to 0° C. at a temperature drop rate of 10° C./minute, and the sample was further heated to 150° C. at a temperature rise rate of 10° C./minute to measure an endothermic heat amount thereof. The temperature at which an extension of the baseline below the endothermic maximum temperature was intersected with a tangential line having a maximum inclination of the curve in the range of from a rise-up portion to an apex of the peak was read as the glass transition temperature.

[Measurement of Endothermic Amount Ratio $\Delta H_{CW/W}$]

Using a differential scanning calorimeter "Q100" available from TA Instruments Japan Inc., first, a polypropylene-base wax (in the form of particles having a particle size of 0.1 to 10 mm) was weighed in an amount of 0.01 to 0.02 g in an aluminum pan, heated to 200° C. and then cooled from 200° C. to 0° C. at a temperature drop rate of 10° C./minute. Then, the sample was further heated to 150° C. at a temperature rise rate of 10° C./min to measure an endothermic amount $\Delta H_W$ of a melting endothermic peak per 1 g of the wax as measured with respect to the wax singly.

Next, an endothermic amount of the resin binder composition was measured under the same conditions as described above to determine an endothermic amount $\Delta H_{CW}$ of a melting endothermic peak per 1 g of the wax as measured with respect to the resin binder composition.

The endothermic amount ratio $\Delta H_{CW/W}$ was calculated from the thus obtained $\Delta H_W$ and $\Delta H_{CW}$ according to the following formula (1):

$$\text{Endothermic Amount Ratio } \Delta H_{CW/W} = \Delta H_{CW}/\Delta H_W \quad (1).$$

Meanwhile, in the case where the endothermic peak of the wax was overlapped with the endothermic peak of the resin binder, the endothermic amount per 1 g of the resin binder as measured with respect to the resin binder solely was previously measured, and by subtracting the thus measured endothermic amount attributed to the resin binder solely from the endothermic amount of the resin binder composition, it is possible to calculate the endothermic amount $\Delta H_{CW}$ attributed to the wax.

[Volume Median Particle Size ($D_{50}$) of Toner]

The volume median particle size ($D_{50}$) of the toner was measured by the following method.

Measuring Apparatus: "Coulter Multisizer II" commercially available from Beckman Coulter Inc.

Aperture Diameter: 50 μm

Analyzing Software: "Coulter Multisizer AccuComp Ver. 1.19" commercially available from Beckman Coulter Inc.

Electrolyte Solution: "Isotone II" commercially available from Beckman Coulter Inc.

Dispersing Solution:

A 5% electrolyte solution of "EMULGEN 109P" (polyoxyethylene lauryl ether; HLB: 13.6) commercially available from Kao Corporation.

Dispersing Conditions:

Ten milligrams of a sample to be measured were added to 5 mL of the aforementioned dispersing solution, and dispersed therein using an ultrasonic disperser for 1 minute. Thereafter, 25 mL of the electrolyte solution was added to the resulting dispersion, and the obtained mixture was further dispersed using the ultrasonic disperser for 1 minute.

Measuring Conditions:

The thus prepared dispersion and 100 mL of the electrolyte solution were added to a beaker, and after controlling a concentration of the resultant dispersion in the beaker so as to complete the measurement for particle sizes of 30000 particles within 20 seconds, the particle sizes of the 30000 particles in the dispersion were measured under this condition, and the volume median particle size ($D_{50}$) of the particles was determined from a particle size distribution thereof.

[Volume Median Particle Sizes ($D_{50}$) of Resin Binder Particles, Colorant Particles and Charge Controlling Agent Particles]

The volume median particle sizes ($D_{50}$) of the resin binder particles, the colorant particles and the charge controlling agent particles were measured by the following method.

(1) Measuring Apparatus: Laser diffraction particle size analyzer "LA-920" commercially available from HORIBA Ltd.

(2) Measuring Conditions: In a cell for the measurement which was filled with distilled water, the volume median particle size ($D_{50}$) of the particles in the dispersion was measured at a concentration at which an absorbance thereof fell within an adequate range.

[Solid Contents of Colorant Dispersion, Charge Controlling Agent Dispersion and Aqueous Dispersion of Resin Binder Composition]

Using an infrared moisture meter "FD-230" available from Kett Electric Laboratory, 5 g of a sample to be measured was dried at a drying temperature of 150° C. under a measuring mode 96 (monitoring time: 2.5 minutes/variation range: 0.05%), and then subjected to measurement of a water content (% by mass) of the sample. The solid contents of the respective dispersions were calculated according to the following formula:

$$\text{Solid content (\% by mass)} = 100 - \text{water content (\% by mass) of sample.}$$

[Particle Size of Wax Dispersed]

A Maruemu Screw Vial No. 7 was charged with 1 g of the resin binder composition and 30 g of methyl ethyl ketone, and the contents of the screw vial were stirred at room temperature (25° C.) for 1 hour using a stirring device "Mix Rotor Variable VMR-5R" available from AS ONE Corporation to dissolve the resin component therein. Thereafter, using a dynamic light scattering particle size measuring apparatus "ZETA SIZER NANOZS" available from Malvern Instruments Ltd., the volume median particle sizes ($D_{50}$) of the particles in the resulting dispersion was measured under the following conditions, and the thus measured value was defined as a volume median particle sizes ($D_{50}$) of the whole wax particles.

Solid content: 0.1% by mass

Measuring temperature: 25° C.

Medium: methyl ethyl ketone

Cell for measurement: Glass Cuvette

Specification of laser: He—Ne, 4 mW, 633 nm

Detection optical system: NIBS, 173° C.

Measurement frequency: 10 times

Isothermalization time: 5 minutes

Analyzing software: "Zeta Sizer Software 6.2"

Analyzing method: General Purpose Mode (cumulant method)

The wax dispersion was stirred and then allowed to stand for 24 hours, so that a large particle size component of the wax was precipitated. A whole amount of the resulting supernatant solution (transparent portion) of the dispersion was rapidly sampled with a Pasteur pipette and then subjected to measurement of a volume median particle sizes ($D_{50}$) of the particles therein by the same method as mentioned above, and the thus measured value was defined as a volume median particle sizes ($D_{50}$) of a small particle size component of the wax as measured by a dynamic light scattering method. In addition, the precipitated component of the dispersion was rinsed with 10 mL of methyl ethyl ketone twice, and then solid components were taken out therefrom. The mass of the thus obtained solid components was measured and defined as a mass ($M_b$) of a large particle size component of the wax.

Furthermore, the supernatant solution was separated into the wax and the polyester-based resin using a high-speed centrifuge "3K30C" available from SIGMA Laborzentrifugen GmbH, Germany) under the following conditions.

Temperature: 25° C.

Weight of sample: 20 g

Rotor: "12158-H"

Sampling cell: "Centrifuge Ware 3119-0030" available from Nalgene

Sampling amount: 20 g

Rotating speed: 20000 rpm

RCF (relative centrifugal acceleration): $3.5\times10^4$ G

Time: 5 hours

The precipitated component was rinsed with 10 mL of methyl ethyl ketone twice, and then solid components were taken out therefrom. The mass of the thus obtained solid components was measured and defined as a mass ($M_s$) of the small particle size component of the wax.

Content (% by mass) of large particle size component of wax=[mass ($M_b$) of large particle size component/(mass ($M_b$) of large particle size component+mass ($M_s$) of small particle size component)]×100

Content (% by mass) of small particle size component of wax=[mass ($M_s$) of small particle size component/(mass ($M_b$) of large particle size component+mass ($M_s$) of small particle size component)]×100

[Production of Resins]

[Production of Non-Crystalline Composite Resins]

Production Examples 1 to 11 and 13 to 15

(Production of Resins A to K and X to Z)

The raw material monomers of a polyester-based resin except for fumaric acid and trimellitic anhydride as well as the esterification catalyst and the esterification co-catalyst as shown in Table 1 were charged into a 10 L four-necked flask equipped with a thermometer, a stainless steel stirring bar, a falling type condenser and a nitrogen inlet tube. The contents of the flask were heated to 235° C. in a mantle heater in a nitrogen atmosphere over 2 hours. Thereafter, the contents of the flask were subjected to polycondensation reaction at 235° C. for 10 hours, and then further reacted under a reduced pressure of 8 kPa for 1 hour. Then, after cooling the contents of the flask to 160° C., the wax shown in Table 1 was charged into the flask. Thereafter, a mixed solution containing the raw material monomers of a vinyl-based resin, the bireactive monomer and the radical polymerization initiator as shown in Table 1 was added dropwise into the flask over 1 hour. After that, the content of the flask were allowed to stand at 160° C. for 30 minutes and subjected to addition polymerization reaction, and then heated to 200° C. over 1 hour and further reacted under a reduced pressure of 8 kPa for 1 hour. Then, after cooling the contents of the flask to 190° C., fumaric acid, trimellitic anhydride and the radical polymerization initiator were added to the flask, and the contents of the flask were heated to 210° C. over 3 hours, and the resulting mixture was reacted at 210° C. under 40 kPa until a softening point of the obtained reaction product reached the temperature shown in Table 1, thereby obtaining a non-crystalline composite resin.

Meanwhile, the time of addition of the wax, the amount of the wax added, the addition or non-addition of the wax, etc., were selected according to Table 1 to synthesize the resin.

Production Example 12

(Production of Resin L)

The raw material monomers of a polyester-based resin moiety except for fumaric acid and trimellitic anhydride as well as the esterification catalyst and the esterification co-catalyst as shown in Table 1 were charged into a 10 L four-necked flask equipped at an upper portion thereof with a thermometer, a stainless steel stirring bar and a reflux condenser through which water at 25° C. was passed, and equipped at a lower portion thereof with a fractionating tube through which hot water at 98° C. was passed, a dehydration tube and a nitrogen inlet tube. The contents of the flask were subjected to polycondensation reaction in a mantle heater in a nitrogen atmosphere at 160° C. for 2 hours, and then heated to 220° C. over 10 hours. Then, after confirming that the reaction rate at 220° C. reached 95% and cooling the contents of the flask to 160° C., the wax shown in Table 1 was charged into the flask. Thereafter, a mixed solution containing the raw material monomers of a vinyl-based resin moiety, the bireactive monomer and the radical polymerization initiator as shown in Table 1 was added dropwise into the flask over 1 hour. After that, the content of the flask were allowed to stand at 160° C. for 30 minutes, and then heated to 200° C. over 1 hour and further reacted under a reduced pressure of 8 kPa for 1 hour. Then, after cooling the contents of the flask to 190° C., fumaric acid, trimellitic anhydride and the radical polymerization initiator were added to the flask, and the contents of the flask were heated to 210° C. over 3 hours, and the resulting mixture was reacted at 210° C. under 40 kPa until a softening point of the obtained reaction product reached the temperature shown in Table 1, thereby obtaining a resin L. Meanwhile, the "reaction rate" as used in the present invention means the value obtained according to the following formula:

Reaction rate=amount of reaction water produced (mol)/theoretical amount of water produced (mol)×100

TABLE 1

| | | | Production Example 1 | | Production Example 2 | | Production Example 3 | | Production Example 4 | |
|---|---|---|---|---|---|---|---|---|---|---|
| Resin binder (composite resin) | | | A | | B | | C | | D | |
| | | | g | mole part(s) *2 | g | mole part(s) *2 | g | mole part(s) *2 | g | mole part(s) *2 |
| Raw material monomer (A) of polyester resin segment | Alcohol component | BPA-PO (*1) | 2469 | 70 | 2469 | 70 | 2469 | 70 | 2469 | 70 |
| | | BPA-EO (*1) | 983 | 30 | 983 | 30 | 983 | 30 | 983 | 30 |
| | | 1,2-Propanediol | | | | | | | | |
| | Acid component | Terephthalic acid | 1004 | 60 | 1004 | 60 | 1004 | 60 | 1004 | 60 |
| | | Fumaric acid | 234 | 20 | 234 | 20 | 234 | 20 | 234 | 20 |
| | | Trimellitic anhydride | 194 | 10 | 194 | 10 | 194 | 10 | 194 | 10 |
| Bireactive monomer | | Acrylic acid | 116 | 8 | 116 | 8 | 116 | 8 | 116 | 8 |

TABLE 1-continued

| | | g | % by mass *3 | g | % by mass *3 | g | % by mass *3 | g | % by mass *3 |
|---|---|---|---|---|---|---|---|---|---|
| Raw material monomer (B) of vinyl-based resin segment | Styrene | 2203 | 80 | 2203 | 80 | 2203 | 80 | 2203 | 80 |
| | Stearyl methacrylate (C18) | 551 | 20 | 551 | 20 | 551 | 20 | 551 | 20 |
| | Octyl methacrylate (C8) | | | | | | | | |
| Wax | Wax (W-1) NP056 (g) *4 | 771 | | 771 | | | | 0 | |
| | Wax (W-1) NP505 (g) *4 | | | | | | | | |
| | HNP9 (g) *4 | | | | | 771 | | | |
| | Time of addition of wax *5 | A | | C | | B | | — | |
| | Content of wax on the basis of 100 parts by mass of resin binder (part(s) by mass) | 10 | | 10 | | 10 | | 0 | |
| | Endothermic amount ratio ΔHcw/w | 0.51 | | 0.95 | | 0.57 | | — | |

| | | Production Example 1 | Production Example 2 | Production Example 3 | Production Example 4 |
|---|---|---|---|---|---|
| Esterification catalyst | Tin (II) di(2-ethyl hexanoate) (g) | 40 | 40 | 40 | 40 |
| Esterification co-catalyst | Gallic acid (g) | 1.6 | 1.6 | 1.6 | 1.6 |
| Radical polymerization initiator | Dibutyl peroxide (g) | 330 | 330 | 330 | 330 |
| Radical polymerization inhibitor | 4-t-Butyl catechol (g) | 4 | 4 | 4 | 4 |
| Content of vinyl-based resin segment in composite resin (% by mass) | | 40 | 40 | 40 | 40 |
| Content of C6-22 in raw material monomer (B) (% by mass) *6 | | 20 | 20 | 20 | 20 |
| Properties | Softening point (° C.) | 124 | 127 | 120 | 127 |
| | Glass transition temperature (° C.) | 55 | 57 | 57 | 58 |
| | Acid value (mgKOH/g) | 12 | 10 | 14 | 10 |
| | Volume median particle size of small particle size component (nm) | 145 | — | 161 | — |
| | Content of small particle size component (% by mass) | 60 | 0 | 45 | — |
| | Volume median particle size of whole wax particles (μm) | 18.6 | 28.7 | 21.3 | — |
| | Content of large particle size component (% by mass) | 40 | 100 | 55 | — |

| | | | Production Example 5 | | Production Example 6 | | Production Example 7 | | Production Example 8 | |
|---|---|---|---|---|---|---|---|---|---|---|
| Resin binder (composite resin) | | | E | | F | | G | | H | |
| | | | g | mole part(s) *2 | g | mole part(s) *2 | g | mole part(s) *2 | g | mole part(s) *2 |
| Raw material monomer (A) of polyester resin segment | Alcohol component | BPA-PO (*1) | 2469 | 70 | 988 | 70 | 2469 | 70 | 2469 | 70 |
| | | BPA-EO (*1) | 983 | 30 | 393 | 30 | 983 | 30 | 983 | 30 |
| | | 1,2-Propanediol | | | | | | | | |
| | Acid component | Terephthalic acid | 1004 | 60 | 402 | 60 | 1004 | 60 | 1004 | 60 |
| | | Fumaric acid | 234 | 20 | 94 | 20 | 234 | 20 | 234 | 20 |
| | | Trimellitic anhydride | 194 | 10 | 77 | 10 | 194 | 10 | 194 | 10 |
| Bireactive monomer | | Acrylic acid | 116 | 8 | 47 | 8 | 116 | 8 | 116 | 8 |

| | | g | % by mass *3 | g | % by mass *3 | g | % by mass *3 | g | % by mass *3 |
|---|---|---|---|---|---|---|---|---|---|
| Raw material monomer (B) of vinyl-based resin segment | Styrene | 2203 | 80 | 881 | 80 | 2699 | 98 | 1101 | 40 |
| | Stearyl methacrylate (C18) | 551 | 20 | 220 | 20 | 55 | 2 | 1652 | 60 |
| | Octyl methacrylate (C8) | | | | | | | | |
| Wax | Wax (W-1) NP056 (g) *4 | 154 | | 1696 | | 771 | | 771 | |
| | Wax (W-1) NP505 (g) *4 | | | | | | | | |
| | HNP9 (g) *4 | | | | | | | | |

TABLE 1-continued

| | | | | | |
|---|---|---|---|---|---|
| | Time of addition of wax *5 | B | B | B | B |
| | Content of wax on the basis of 100 parts by mass of resin binder (part(s) by mass) | 2 | 55 | 10 | 10 |
| | Endothermic amount ratio ΔHcw/w | 0.49 | 0.62 | 0.59 | 0.45 |

| | | Production Example 5 | Production Example 6 | Production Example 7 | Production Example 8 |
|---|---|---|---|---|---|
| Esterification catalyst | Tin (II) di(2-ethyl hexanoate) (g) | 40 | 40 | 40 | 40 |
| Esterification co-catalyst | Gallic acid (g) | 1.6 | 1.6 | 1.6 | 1.6 |
| Radical polymerization initiator | Dibutyl peroxide (g) | 330 | 330 | 330 | 330 |
| Radical polymerization inhibitor | 4-t-Butyl catechol (g) | 4 | 4 | 4 | 4 |
| | Content of vinyl-based resin segment in composite resin (% by mass) | 40 | 40 | 40 | 40 |
| | Content of C6-22 in raw material monomer (B) (% by mass) *6 | 20 | 20 | 2 | 60 |
| Properties | Softening point (° C.) | 125 | 115 | 128 | 109 |
| | Glass transition temperature (° C.) | 56 | 52 | 59 | 50 |
| | Acid value (mgKOH/g) | 13 | 13 | 10 | 11 |
| | Volume median particle size of small particle size component (nm) | 126 | 154 | 153 | 144 |
| | Content of small particle size component (% by mass) | 64 | 42 | 45 | 64 |
| | Volume median particle size of whole wax particles (μm) | 8.6 | 27.3 | 19.1 | 16.4 |
| | Content of large particle size component (% by mass) | 36 | 58 | 55 | 36 |

| | | | Production Example 9 | | Production Example 10 | | Production Example 11 | | Production Example 12 | |
|---|---|---|---|---|---|---|---|---|---|---|
| Resin binder (composite resin) | | | I | | J | | K | | L | |
| | | | g | mole part(s) *2 | g | mole part(s) *2 | g | mole part(s) *2 | g | mole part(s) *2 |
| Raw material monomer (A) of polyester resin segment | Alcohol component | BPA-PO (*1) | 2469 | 70 | 2513 | 70 | 1482 | 70 | | |
| | | BPA-EO (*1) | 983 | 30 | 1002 | 30 | 590 | 30 | | |
| | | 1,2-Propanediol | | | | | | | 1656 | 100 |
| | Acid component | Terephthalic acid | 1004 | 60 | 1022 | 60 | 602 | 60 | 2159 | 60 |
| | | Fumaric acid | 234 | 20 | 238 | 20 | 140 | 20 | 505 | 20 |
| | | Trimellitic anhydride | 194 | 10 | 197 | 10 | 116 | 10 | 418 | 10 |
| Bireactive monomer | | Acrylic acid | 116 | 8 | 30 | 8 | 70 | 16 | 251 | 16 |
| | | | g | % by mass *3 | g | % by mass *3 | g | % by mass *3 | g | % by mass *3 |
| Raw material monomer (B) of vinyl-based resin segment | | Styrene | 2203 | 80 | 103 | 80 | 2974 | 80 | 1996 | 80 |
| | | Stearyl methacrylate (C18) | | | 26 | 20 | 743 | 20 | 499 | 20 |
| | | Octyl methacrylate (C8) | 551 | 20 | | | | | | |
| Wax | | Wax (W-1) NP056 (g) *4 | 771 | | 479 | | 693 | | 698 | |
| | | Wax (W-1) NP505 (g) *4 | | | | | | | | |
| | | HNP9 (g) *4 | | | | | | | | |
| | | Time of addition of wax *5 | B | | B | | B | | B | |
| | | Content of wax on the basis of 100 parts by mass of resin binder (part(s) by mass) | 10 | | 10 | | 10 | | 10 | |
| | | Endothermic amount ratio ΔHcw/w | 0.67 | | 0.71 | | 0.38 | | 0.49 | |

| | | Production Example 9 | Production Example 10 | Production Example 11 | Production Example 12 |
|---|---|---|---|---|---|
| Esterification catalyst | Tin (II) di(2-ethyl hexanoate) (g) | 40 | 40 | 40 | 40 |
| Esterification co-catalyst | Gallic acid (g) | 1.6 | 1.6 | 1.6 | 1.6 |

TABLE 1-continued

| | | | | | |
|---|---|---|---|---|---|
| Radical polymerization initiator | Dibutyl peroxide (g) | 330 | 15 | 446 | 299 |
| Radical polymerization inhibitor | 4-t-Butyl catechol (g) | 4 | 4 | 4 | 4 |
| Content of vinyl-based resin segment in composite resin (% by mass) | | 40 | 3 | 60 | 40 |
| Content of C6-22 in raw material monomer (B) (% by mass) *6 | | 20 | 20 | 20 | 20 |
| Properties | Softening point (° C.) | 130 | 112 | 132 | 118 |
| | Glass transition temperature (° C.) | 60 | 54 | 56 | 52 |
| | Acid value (mgKOH/g) | 8 | 10 | 12 | 14 |
| | Volume median particle size of small particle size component (nm) | 160 | 194 | 158 | 175 |
| | Content of small particle size component (% by mass) | 27 | 20 | 67 | 59 |
| | Volume median particle size of whole wax particles (μm) | 24.2 | 29.4 | 16.3 | 23.6 |
| | Content of large particle size component (% by mass) | 73 | 80 | 33 | 41 |

| | | | Production Example 13 | | Production Example 14 | | Production Example 15 | |
|---|---|---|---|---|---|---|---|---|
| Resin binder (composite resin) | | | M | | N | | O | |
| | | | g | mole part(s) *2 | g | mole part(s) *2 | g | mole part(s) *2 |
| Raw material monomer (A) of polyester resin segment | Alcohol component | BPA-PO (*1) | 2469 | 70 | 2469 | 70 | 2469 | 70 |
| | | BPA-EO (*1) | 983 | 30 | 983 | 30 | 983 | 30 |
| | | 1,2-Propanediol | | | | | | |
| | Acid component | Terephthalic acid | 1004 | 60 | 1004 | 60 | 1004 | 60 |
| | | Fumaric acid | 234 | 20 | 234 | 20 | 234 | 20 |
| | | Trimellitic anhydride | 194 | 10 | 194 | 10 | 194 | 10 |
| Bireactive monomer | | Acrylic acid | 116 | 16 | 116 | 16 | 116 | 16 |
| | | | g | % by mass *3 | g | % by mass *3 | g | % by mass *3 |
| Raw material monomer (B) of vinyl-based resin segment | | Styrene | 2203 | 80 | 2203 | 80 | 2203 | 80 |
| | | Stearyl methacrylate (C18) | 551 | 20 | 551 | 20 | 551 | 20 |
| | | Octyl methacrylate (C8) | | | | | | |
| Wax | | Wax (W-1) NP056 (g) *4 | | | 463 | | 771 | |
| | | Wax (W-1) NP505 (g) *4 | 771 | | | | | |
| | | HNP9 (g) *4 | | | | | | |
| | | Time of addition of wax *5 | B | | B | | A | |
| | | Content of wax on the basis of 100 parts by mass of resin binder (part(s) by mass) | 10 | | 6 | | 10 | |
| | | Endothermic amount ratio ΔHcw/w | 0.57 | | 0.53 | | 0.61 | |

| | | Production Example 13 | Production Example 14 | Production Example 15 |
|---|---|---|---|---|
| Esterification catalyst | Tin (II) di(2-ethyl hexanoate) (g) | 40 | 40 | 40 |
| Esterification co-catalyst | Gallic acid (g) | 1.6 | 1.6 | 1.6 |
| Radical polymerization initiator | Dibutyl peroxide (g) | 330 | 330 | 330 |
| Radical polymerization inhibitor | 4-t-Butyl catechol (g) | 4 | 4 | 4 |
| Content of vinyl-based resin segment in composite resin (% by mass) | | 40 | 40 | 40 |
| Content of C6-22 in raw material monomer (B) (% by mass) *6 | | 20 | 20 | 20 |
| Properties | Softening point (° C.) | 125 | 125 | 126 |
| | Glass transition temperature (° C.) | 58 | 55 | 56 |
| | Acid value (mgKOH/g) | 13 | 12 | 11 |

TABLE 1-continued

| | | | |
|---|---|---|---|
| Volume median particle size of small particle size component (nm) | 151 | 132 | 156 |
| Content of small particle size component (% by mass) | 48 | 60 | 43 |
| Volume median particle size of whole wax particles (μm) | 19.8 | 13.3 | 23.6 |
| Content of large particle size component (% by mass) | 52 | 40 | 57 |

The annotations with asterisks appearing in Table 1 have the following meanings.

*1: BPA-PO means a polyoxypropylene (2.2) adduct of bisphenol A; and BPA-EO means a polyoxyethylene (2.2) adduct of bisphenol A.

*2: Mole part(s) of respective monomers on the basis of 100 mole parts of an alcohol component of a raw material monomer (A).

*3: Content (% by mass) of respective monomers constituting a raw material monomer (B) in a whole amount of the raw material monomer (B).

*4: NP056: polypropylene wax; NP505; polypropylene wax; HNP9: polyethylene wax.

*5: With respect to the time of addition of the wax, A means the addition before polycondensation; B means the addition after polycondensation but before addition polymerization; and C means the addition after addition polymerization.

*6: Content of a (meth)acrylic acid ester containing an alkyl group having 6 to 22 carbon atoms in a raw material monomer (B).

The details of various waxes shown in Table 1 are as follows.

NP056: Polypropylene wax "NP056" (weight-average molecular weight (Mw): 800; melting point: 123° C.) available from Mitsui Chemicals, Inc.

NP505: Polypropylene wax "NP505" (weight-average molecular weight (Mw); 2500; melting point: 143° C.) available from Mitsui Chemicals, Inc.

HNP9: Polyethylene wax "HNP9" available from Nippon Seiro Co., Ltd.

[Pulverized Toner]

[Production of Toner for Development of Electrostatic Images]

Examples 1 to 12 and Comparative Examples 1 to 3

One hundred (100) parts by mass of the resin shown in Table 2, 0.2 part by mass of a negatively-chargeable charge controlling agent "BONTRONE E-81" available from Orient Chemical Industries Co., Ltd., and 1 part by mass of a colorant "Regal 330R" (carbon black) available from Cabot Corporation were added to a Henschel mixer and sufficiently mixed therein, and then the obtained mixture was melted and kneaded using a co-rotating twin screw extruder at a roll rotating speed of 200 r/min (peripheral speed: 0.3 m/min) at a roll-inside heating temperature of 80° C. The resulting melt-kneaded material was cooled and coarsely pulverized, and then finely pulverized by a jet mill and classified, thereby obtaining toner particles having a volume median particle size ($D_{50}$) shown in Table 2.

One (1.0) part by mass of a hydrophobic silica "NAX-50" (hydrophobic treatment agent: HMDS; average particle size: 30 nm) available from Nippon Aerosil Co., Ltd., was added to 100 parts by mass of the thus obtained toner particles, and the resulting mixture was mixed by a Henschel mixer, thereby obtaining a toner.

[Emulsified Aggregated Toner]

Preparation Example 1

[Production of Colorant Dispersion]

Fifty (50) grams of copper phthalocyanine "ECB-301" available from Dainichiseika Color & Chemicals Mfg. Co., Ltd., 5 g of a nonionic surfactant "EMULGEN 150" (polyoxyethylene lauryl ether) available from Kao Corporation and 200 g of ion-exchanged water were mixed with each other. The resulting mixture was dispersed using a homogenizer for 10 minutes to thereby obtain a colorant dispersion containing colorant particles. The colorant particles had a volume median particle size ($D_{50}$) of 137 nm, and the colorant dispersion had a solid content of 22% by mass.

Preparation Example 2

[Production of Charge Controlling Agent Dispersion]

Fifty (50) grams of a salicylic acid-based compound "BONTRONE E-84" as a charge controlling agent available from Orient Chemical Industries Co., Ltd., 5 g of a nonionic surfactant "EMULGEN 150" available from Kao Corporation and 200 g of ion-exchanged water were mixed with each other. The resulting mixture was dispersed with glass beads using a sand grinder at 25° C. for 10 minutes to thereby obtain a charge controlling agent dispersion containing charge controlling agent particles. The thus obtained charge controlling agent dispersion had a solid content of 20% by mass, and the charge controlling agent particles had a volume median particle size ($D_{50}$) of 500 nm.

[Aqueous Dispersions of Resin Binder Composition]

Preparation Example 3

[Production of Aqueous Dispersion A]

A 3 L-capacity reaction vessel equipped with a stirrer, a reflux condenser, a dropping funnel, a thermometer and a nitrogen inlet tube was charged with 150 g of the composite resin A and 45 g of methyl ethyl ketone (hereinafter also referred to as "MEK"), and the contents of the reaction vessel were dissolved at 73° C. over 2 hours. The resulting solution was mixed with a 5% by mass sodium hydroxide aqueous solution to neutralize the resin such that the degree of neutralization of the resin was 40 mol % on the basis of an acid value of the resin, followed by stirring the resulting mixture for 30 minutes. Thereafter, while maintaining the obtained reaction solution at a temperature of 30° C. and continuously stirring the reaction solution at a rotating speed of 280 r/min (peripheral speed: 88 m/min), 675 g of deionized water was added to the solution over 77 minutes. Next, the resulting solution was heated to 50° C. over 30 minutes, and then MEK was removed therefrom by distillation under reduced pressure. Thereafter, while continuously stirring the thus obtained aqueous dispersion at a rotating speed of 280 r/min (peripheral speed: 88 m/min), the aqueous dispersion was cooled to 30° C., and then mixed with 16.7 g of an anionic surfactant "EMAL E-27C" (sodium polyoxyethylenelaurylethersulfate) available from Kao Corporation to completely dissolve the solid components therein. Then, the solid content of the resulting dispersion was measured, and ion-exchanged water was added thereto such that the solid content of the aqueous dispersion was reduced to 20% by mass, thereby obtaining an aqueous dispersion A of the resin binder composition. The particles contained in the thus obtained aqueous dispersion had a volume median particle size of 251 nm.

Example 13

[Production of Toner]

A 2 L-capacity reaction vessel was charged with 300 g of the aqueous dispersion A of the resin binder composition, 8 g of the colorant dispersion and 2 g of the charge controlling agent dispersion, which all were prepared in the aforementioned Preparation Examples, as well as 52 g of deionized water. While stirring the contents of the reaction vessel using a stirring device equipped with an anchor blade at a rotating speed of 100 r/min (peripheral speed: 31 m/min), 150 g of a 0.1% by mass calcium chloride aqueous solution was added dropwise thereto at 20° C. over 30 minutes. Thereafter, the contents of the reaction vessel were heated to 50° C. while stirring, and maintained at 50° C. until the volume median particle size of the particles therein became 8 μm. After 3 hours were elapsed, the volume median particle size of the particles reached 8 μm. Thereafter, a dilute solution prepared by diluting 4.2 g of an anionic surfactant "EMAL E-27C" (solid content: 28% by mass) as an aggregation stopping agent available from Kao Corporation with 37 g of deionized water was added to the contents of the reaction vessel. Next, the resulting reaction solution was heated to 80° C., and maintained at 80° C. for 1 hour from the time at which the temperature reached 80° C., and then the heating was stopped, thereby obtaining coalesced particles. The resulting coalesced particles were gradually cooled to 20° C., and filtered through a 150 mesh wire screen (opening: 150 μm), and then subjected to suction filtration, washing and drying steps, thereby obtaining toner particles E-A.

(External Addition Step)

One hundred (100) parts by mass of the aforementioned toner particles, 1.0 part by mass of a hydrophobic silica "NAX-50" (number-average particle size: 40 nm) available from Nippon Aerosil Co., Ltd., 0.6 part by mass of a hydrophobic silica "R972" (number-average particle size: 16 nm) available from Nippon Aerosil Co., Ltd., and 0.5 part by mass of titanium oxide "JMT-150IB" (number-average particle size: 15 nm) available from TAYCA Corporation were charged into a 10 L Henschel mixer available from Nippon Coke & Engineering, Co., Ltd., equipped with an agitation blade "ST, A0", and stirred at 3000 rpm for 2 minutes, thereby obtaining a toner. The evaluation results of the thus obtained toner are shown in Table 2.

[Residual Rate of Density of Toner Images (Evaluation of Fusing Properties of Toner on Polypropylene Film)]

The toner was loaded into a copying machine "AR-505" available from Sharp Corporation to form unfused images (printing area: 2 cm×12 cm; amount of toner deposited: 0.5 mg/cm$^2$). The resulting unfused images were fused on a printing medium using a fuser of the copying machine under the printing conditions of a temperature of 130° C. and a printing speed of 400 mm/sec. Meanwhile, as the printing medium, there was used a polypropylene film "OPU-0" available from Mitsui Chemicals Tohcello, Inc. A cellophane tape available from Nichiban Co., Ltd., was attached onto the printed surface of the polypropylene film by applying a load of 20 N thereto, and then manually peeled off therefrom to measure a reflection density of the tape-attached portion of the printed surface before attaching the tape thereto and after being peeled off the tape therefrom using a spectrophotometric colorimeter "NF777CE" available from Nippon Denshoku Industries Co., Ltd. The residual rate of density of the thus printed toner images was calculated from the thus measured reflection density values according to the following formula to evaluate fusing properties of the toner images on the polypropylene film. The higher the residual rate of density of the toner images, the more excellent the fusing properties of the toner images on the polypropylene film.

Residual rate (%) of density of toner images=(reflection density after peeling off the tape/reflection density before attaching the tape)×100

[Transparency of Printed Material]

The toner was loaded into a copying machine "AR-505" available from Sharp Corporation to form unfused images (printing area: 2 cm×12 cm; amount of toner deposited: 0.5 mg/cm$^2$). The resulting unfused images were fused on a printing medium using a fuser of the copying machine under the printing conditions of a temperature of 150° C. and a printing speed of 400 mm/sec. Meanwhile, as the printing medium, there was used a polypropylene film "OPU-0" available from Mitsui Chemicals Tohcello, Inc. Thereafter, a transparency of the obtained printed material was measured using a spectrophotometric colorimeter "SE-2000" available from Nippon Denshoku Industries Co., Ltd. The printed material having a higher transparency is preferred.

TABLE 2

| | Resin | Toner particles | Particle size of toner (μm) | CV of toner (%) | Fusing properties onto PP film (%) | Transparency of printed material (%) |
|---|---|---|---|---|---|---|
| Example 1 | A | A | 8.1 | 32 | 95 | 91 |
| Comparative Example 1 | B | B | 8.0 | 31 | 18 | 21 |
| Comparative Example 2 | C | C | 8.2 | 35 | 24 | 85 |
| Comparative Example 3 | D | D | 8.1 | 32 | 0 | 98 |
| Example 2 | E | E | 8.0 | 34 | 71 | 93 |
| Example 3 | F | F | 8.4 | 31 | 86 | 83 |
| Example 4 | G | G | 8.2 | 30 | 85 | 81 |

TABLE 2-continued

| | Resin | Toner particles | Particle size of toner (μm) | CV of toner (%) | Fusing properties onto PP film (%) | Transparency of printed material (%) |
|---|---|---|---|---|---|---|
| Example 5 | H | H | 8.3 | 32 | 96 | 89 |
| Example 6 | I | I | 8.1 | 33 | 85 | 83 |
| Example 7 | J | J | 8.2 | 32 | 82 | 79 |
| Example 8 | K | K | 8.0 | 31 | 87 | 84 |
| Example 9 | L | L | 2.0 | 32 | 86 | 87 |
| Example 10 | M | M | 8.2 | 34 | 94 | 84 |
| Example 11 | N | N | 8.0 | 33 | 88 | 94 |
| Example 12 | O | O | 8.0 | 33 | 93 | 88 |
| Example 13 | A | E-A | 7.9 | 29 | 91 | 87 |

INDUSTRIAL APPLICABILITY

In accordance with the present invention, it is possible to obtain a toner for development of electrostatic images which is excellent in fusing properties onto a PP film.

The invention claimed is:

1. A resin binder composition for toners for development of electrostatic images comprising a polyester-based resin and a polypropylene-based wax (W-1), wherein:

the polyester-based resin is in the form of a composite resin (HB) comprising a polyester-based resin segment (A) and a vinyl-based resin segment (B) comprising a constitutional unit derived from a vinyl-based monomer comprising an alkyl group having not less than 10 and not more than 22 carbon atoms in an amount of not less than 1% by mass and not more than 70% by mass;

a mass ratio of the polyester-based resin segment (A) to the vinyl-based resin segment (B) [(A)/(B)] in the composite resin (HB) is not less than 40/60 and not more than 95/5; and the resin binder composition has an endothermic amount ratio $\Delta H_{CW/W}$ of not less than 0.10 and not more than 0.80, the endothermic amount ratio $\Delta H_{CW/W}$ being represented by the following formula (1):

$$\text{Endothermic Amount Ratio } \Delta H_{CW/W} = \Delta H_{CW} / \Delta H_{W} \quad (1)$$

wherein $\Delta H_{CW}$ is an endothermic amount of a melting endothermic peak per 1 g of the polypropylene-based wax (W-1) as measured with respect to the resin binder composition;

and $\Delta H_{W}$ is an endothermic amount of a melting endothermic peak per 1 g of the polypropylene-based wax (W-1) as measured with respect to the polypropylene-based wax (W-1) singly, $\Delta H_{CW}$ and $\Delta H_{W}$ each representing an endothermic amount as measured at a temperature rise rate of 10° C./min using a differential scanning calorimeter.

2. The resin binder composition for toners for development of electrostatic images according to claim 1, wherein a content of the polypropylene-based wax (W-1) in the resin binder composition is not less than 3 parts by mass and not more than 60 parts by mass on the basis of 100 parts by mass of the polyester-based resin.

3. The resin binder composition for toners for development of electrostatic images according to claim 1, wherein an alcohol component as a raw material monomer of the polyester-based resin comprises an alkyleneoxide adduct of bisphenol A represented by the following formula (I) in an amount of not less than 80 mol % and not more than 100 mol %, (I)

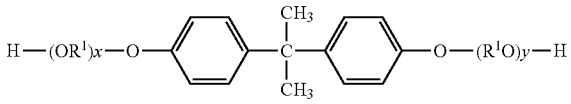

wherein $R^1$ is an alkylene group having 2 or 3 carbon atoms; and x and y are each a positive number representing an average molar number of addition of an alkyleneoxide, and a sum of x and y is from 1 to 16.

4. A toner for development of electrostatic images comprising the resin binder composition according to claim 1.

5. A printing method comprising printing images on a polypropylene film by an electrophotographic method using the toner for development of electrostatic images according to claim 4.

6. The resin binder composition for toners for development of electrostatic images according to claim 1, wherein the endothermic amount ratio $\Delta H_{CW/W}$ is in a range of not less than 0.20 and not more than 0.80.

7. The resin binder composition for toners for development of electrostatic images according to claim 1, wherein the endothermic amount ratio $\Delta H_{CW/W}$ is in a range of not less than 0.30 and not more than 0.80.

8. The resin binder composition for toners for development of electrostatic images according to claim 1, wherein the endothermic amount ratio $\Delta H_{CW/W}$ is in a range of not less than 0.38 and not more than 0.71.

* * * * *